US005958150A

United States Patent [19]

Borger et al.

[11] Patent Number: 5,958,150

[45] **Date of Patent: *Sep. 28, 1999**

[54] STORAGE AND CLEANING UNIT FOR A TOILET PLUNGER

[76] Inventors: Nancy G. Borger; Gary A. Borger, both of 5001 Packer Dr., Wausau, Wis. 54401

[ * ] Notice: This patent is subject to a terminal disclaimer.

[21] Appl. No.: 09/093,925

[22] Filed: Jun. 9, 1998

Related U.S. Application Data

[63] Continuation-in-part of application No. 08/852,805, May 7, 1997.

[51] Int. Cl.[6] ..... B08B 7/00; B65D 83/00

[52] U.S. Cl. ..... 134/42; 134/183; 206/15.3; 206/361

[58] Field of Search ..... 134/42, 183; 206/15.3, 206/361

[56] References Cited

U.S. PATENT DOCUMENTS

| | | | |
|---|---|---|---|
| 242,254 | 5/1881 | Bird | 220/252 |
| 245,728 | 8/1881 | Landis | 220/252 |
| D. 279,145 | 6/1985 | Lippe | D3/75 |
| D. 315,269 | 3/1991 | Brazis | D6/551 |
| D. 343,058 | 1/1994 | Allegre | D3/39 |
| D. 362,575 | 9/1995 | Bird et al. | D6/551 |
| 2,757,787 | 8/1956 | Sergent | 206/361 X |
| 3,229,846 | 1/1966 | Katz | 220/252 |
| 3,361,507 | 1/1968 | O'Neil | 206/361 X |
| 3,640,420 | 2/1972 | Carter et al. | 220/592.2 |
| 4,776,456 | 10/1988 | Lewis | 206/15.3 |
| 5,114,006 | 5/1992 | Wilk . | |
| 5,305,880 | 4/1994 | Wilk et al. | 206/349 |
| 5,307,930 | 5/1994 | Wilk et al. | 206/349 |
| 5,335,374 | 8/1994 | Wilk et al. | 4/255.11 X |
| 5,456,356 | 10/1995 | Kurzawa | 206/349 |
| 5,772,015 | 6/1998 | Musiel et al. | 206/361 |
| 5,836,322 | 11/1998 | Borger et al. | 134/42 |

FOREIGN PATENT DOCUMENTS

| | | | |
|---|---|---|---|
| 219339 | 12/1958 | Australia | 206/361 |

*Primary Examiner*—Jill Warden
*Assistant Examiner*—Saeed Chaudhry
*Attorney, Agent, or Firm*—Michael Best & Friedrich LLP

[57] ABSTRACT

A device for storing and cleaning a toilet plunger includes an open-topped container and a lid having two lid-halves with each lid-half having an interior surface and an exterior surface. An internal closure mechanism having two closure members is disposed within the lid with one closure member projecting from the interior surface in each lid-half. Each closure member has at least one bumper/lever member. Each bumper/lever member has a curved member having a curved portion for engaging a side wall of a toilet plunger cup and a linear member having a linear portion for engaging a toilet plunger cup end wall. Preferably each closure member has a pair of bumper/lever members with a cross member joining them. The container has a base having upstanding walls, a base top having base raised portions and base lowered portions, a base top surface and an opposing bottom surface. A counterweight is preferably disposed under the bottom surface. The container walls have a portion defining a pour spout. The container and the lid are dimensioned for enclosing both the toilet plunger cup and a portion of the toilet plunger handle. The remainder of the toilet plunger handle protrudes through a hole in the lid when the toilet plunger is in the device. A handle is affixed to the walls of the container. A method for opening and closing the device using a toilet plunger and a method of cleaning a toilet plunger are disclosed.

20 Claims, 21 Drawing Sheets

STORAGE AND CLEANING UNIT FOR A TOILET PLUNGER

CROSS-REFERENCE TO RELATED APPLICATIONS

This application is a continuation-in-part of U.S. Application Ser. No. 08/852,805 filed May 7, 1997.

STATEMENT REGARDING FEDERALLY SPONSORED RESEARCH OR DEVELOPMENT

Not Applicable

BACKGROUND OF THE INVENTION

This invention relates generally to bathroom accessories and in particular, to a device for storing and cleaning a toilet plunger.

Toilet plungers have long been used to unblock drains. Such toilet plungers are difficult to store because of the limited amount of space in most bathrooms; in addition, toilet plungers are unsightly and unsanitary. Yet the toilet plunger should be readily available when necessary to remove blockages in the drains.

Some prior art has attempted to respond to the storage and convenience-of-use problems, providing toilet plunger covers and/or combination toilet plunger covers and toilet plungers. In U.S. Pat. No. 5,114,006 to Wilk, and U.S. Pat. Nos. 5,335,374 and 5,305,880 to Wilk et al., the toilet plunger housing is part of the toilet plunger. The Wilk ('006) combination toilet plunger and housing device has a housing with a slotted base which rests directly on the floor, wherein the plunger cup rests upon the slots when the plunger is in storage, and the same slots are used for grasping of the housing when the plunger is extended for use. Other embodiments of Wilk ('006) disclose the plunger cup resting on a removable base plate when the plunger is in a storage position.

Wilk et al. ('880) discloses a combination toilet plunger and housing device where the housing has an open end resting on the floor and the toilet plunger in the stored position has its plunger cup directed to the floor.

Wilk et al. ('374) discloses a combination toilet plunger and housing device having an open ended tubular housing member which covers the plunger cup allowing the plunger cup to rest directly on the floor. The handle of the device permits telescoping in the stored position.

U.S. Pat. No. 5,456,356 to Kurzawa discloses a combination toilet plunger cover and toilet tissue roll having a detachable base plate. The top surface of the base plate has upwardly extending ribs on which the plunger cup rests to prevent drainage of a wet plunger onto a floor. The Kurzawa device generally conforms to the shape of a toilet plunger cup and handle, having an elongate handle portion covering the entire toilet plunger handle.

Thus, notwithstanding the many known practical design problems for bathroom accessory storage devices for toilet plungers, the art has not adequately responded to date with the introduction of a device for storing and cleaning a toilet plunger which permits the user to easily insert a toilet plunger into an open device, without the user touching the plunger cup or the exterior or the interior of the device to close the device, and at the same time, to have the insertion action close the device; which also permits the user to remove the toilet plunger from within a closed device, without the user manipulating the device externally to open the device and without the user touching the plunger cup or the interior of the device to open the device, and have the removal action open the device; which permits the toilet plunger to drain inside the device without draining on the bathroom floor and to contain the drainage; which resists tipping of the device in the storage position, as well as when the toilet plunger is removed from the device; and which permits easy cleaning and sanitizing of the toilet plunger when it is inserted in the device.

BRIEF SUMMARY OF THE INVENTION

The present invention provides an improved device for storing and cleaning a toilet plunger which permits the user to easily insert and to easily remove the toilet plunger without touching the plunger cup of the toilet plunger or the interior of the device. The present invention permits the user to insert a toilet plunger into the open device of the present invention, while the insertion action advantageously closes the device without the user having to touch the device, or the plunger cup of the toilet plunger. Subsequently the user can remove the toilet plunger from within the closed device, without the user manipulating the device externally to open the device and without the user touching the plunger cup or the interior of the device to open the device. The removal action of the toilet plunger by the user advantageously opens the device.

The device also advantageously permits the toilet plunger to drain inside the device without draining on the bathroom floor and permits the drainage to collect in the device. Further, the device of the present invention resists tipping when the device is in the storage position and when the plunger is removed from within the device. The device in accordance with the present invention has yet a further advantage in that the device is suitably configured to hold the toilet plunger, as well as cleaning solutions used for cleaning the toilet plunger. The device provides for drainage of the cleaning solutions after their use, as well as any fluids draining off the toilet plunger after its use. The cleaning feature allows the toilet plunger to be sanitized after use, thus reducing odor and the potential spread of bacteria and other infectious agents.

The foregoing, and other advantages of the present invention, are realized in one aspect thereof in a device for storing and cleaning a toilet plunger. The toilet plunger is of the conventional type having a handle and a cup disposed at the end of the handle. The cup has a sidewall terminating in an end wall. The device comprises an open-topped plunger-receiving container, an upper lid comprising two lid-halves, each lid-half having an interior surface and an exterior surface. The lid is preferably a curved lid having two curved lid-halves. The lid has a hole there through, with the hole penetrating the two lid-halves. A hinge mechanism pivotly connects each lid-half to the container permitting the lid-halves to open outside the container without telescoping on the container and without telescoping on each other. Each lid-half has an outwardly projecting tab on the exterior surface with the tab disposed near the hinge mechanism.

An internal closure mechanism is present for closing and opening the lid-halves using the toilet plunger. The internal closure mechanism comprises a pair of mirror-imaged closure members. The internal closure mechanism is disposed within the lid and extends from the interior surface of each lid half into the device and is adjacent the hole. The internal closure mechanism comprises at least one curved member for engaging the side wall of the cup of the toilet plunger and at least one linear member for engaging an end wall of the cup of the toilet plunger. One of each of the closure members projects from the interior surface of a lid-half into the device. Each closure member has at least one bumper/lever member. Most preferably, each closure member has a pair of bumper/lever members joined by a cross member, providing an H-shaped cross section. Each bumper/lever member has a bumper and a lever. The bumper is adjacent the hole on the lid. Most preferably, the bumper abuts an edge of the hole. The bumper has a D-shaped curved portion and an inwardly bent section, with the D-shaped curved portion directly adjacent to the inwardly bent section. The D-shaped curved portion is suitable for engaging the side wall of the cup of the toilet plunger for opening the lid-halves from within the device. The lever has a generally truncated triangular shape with a first side, an opposite second side and a third side connecting the first side and the second side. The first side is continuous with the inwardly bent section of the bumper. The first side forms a linear portion which is suitable for engaging the end wall of the cup of the toilet plunger for closing the lid-halves. Alternatively, the closure member comprises a single bumper/lever member having a flange extending perpendicularly from the closure member providing each bumper and each lever with a T-bar cross-section shape. Yet alternatively, the flange is absent and the closure member has a rectangular cross-section.

The container has a base having upstanding side walls. The base has a base top having a top surface and an opposing base bottom having a bottom surface. The base has a raised portion and a lowered portion. Preferably the base top has a plurality of raised ridges. A counterweight is disposed on the bottom surface of the base. Alternatively, the counterweight is absent. Yet alternatively, base top has a plurality of grooves. A counterweight is preferably disposed within the base between the top surface and the bottom surface. Still alternatively, the counterweight is recessed into the bottom surface of the base. Yet still, alternatively, the counterweight is absent.

The base further comprises a rim extending from the base and continuous with the walls. The rim is suitable for use as a fingerhold.

The container walls have a spout portion defining a pour spout. Preferably, a detachable handle is releasibly affixed to the container.

The container and the lid are dimensioned for enclosing both the cup of the toilet plunger and a portion of a handle of the toilet plunger, with the remainder of the handle protruding through the hole in the lid when the plunger is in the container.

In another aspect of the present invention, a method for opening and closing a toilet plunger storing and cleaning device, using a toilet plunger is disclosed. The toilet plunger is of the conventional type having a handle, and a cup disposed at the end thereof and having a sidewall terminating in an end wall. The method comprises the steps of: (a) opening a device having (i) an open-topped container having an interior, (ii) a lid thereto having two lid-halves and a hole there through, (iii) a hinge mechanism connecting each lid-half to the container, and (iv) an internal closure mechanism disposed within the lid and adjacent the hole; the hole penetrating the two lid-halves; each lid-half having an interior surface, an exterior surface, and a tab extending from the exterior surface; the internal closure mechanism having at least one curved member having a curved portion for engaging the side wall of the cup of the toilet plunger and at least one linear member having a linear portion for engaging the end wall of the cup of the toilet plunger; by depressing each tab of the lid-halves causing each of the lid-halves to pivot about the hinge mechanism to open and expose the interior of the container; (b) lowering the toilet plunger into the interior of the container; (c) engaging the end wall of the cup of the toilet plunger against the linear portion, causing the lid-halves to pivot shut to close the device; (d) resting the end wall of the cup of the toilet plunger in the container and enclosing both the cup of the toilet plunger and a portion of the handle of the toilet plunger and wherein a remainder of the handle protrudes through the hole in the lid; (e) grasping the handle and pulling the handle toward the lid-halves; and (f) engaging the side wall of the cup of the toilet plunger against the curved portion, causing the lid-halves to pivot open to open the device.

In yet another aspect of the present invention, a method of cleaning a toilet plunger using a device for storing and cleaning a toilet plunger is disclosed. The toilet plunger is of the conventional type having a handle, and a cup disposed at the end thereof and having a sidewall terminating in an end wall. The method comprises the steps of: (a) opening a device comprising (i) an open-topped container having an interior defined by upstanding walls and a base, said walls having a spout portion defining a pour spout, (ii) a lid having two lid-halves and a hole there through, each lid-half having an interior surface and an exterior surface, and a tab extending from the exterior surface; the hole penetrating the two lid-halves, (iii) a hinge mechanism connecting each of the lid-halves to the container, and (iv) an internal closure mechanism disposed within the lid and adjacent the hole, the internal closure mechanism having at least one curved member having a curved portion for engaging the side wall of the cup of the toilet plunger and at least one linear member having a linear portion for engaging the end wall of the cup of the toilet plunger, by depressing the tabs on the lid-halves causing each of the lid-halves to pivot about the hinge mechanism opening and exposing the interior of the container; (b) pouring a cleaning solution into the container; (c) lowering the toilet plunger into the container; (d) engaging the end wall of the cup of the toilet plunger against the linear portion, causing the lid-halves to pivot shut, closing the device; (e) resting the end wall of the cup of the toilet plunger in the container and enclosing both the cup of the toilet plunger and a portion of the handle of the toilet plunger and a remainder of the handle protrudes through the hole in the lid; (f) soaking the toilet plunger in the cleaning solution; and (g) tipping the device and draining the cleaning solution from the device through the pour spout.

Other advantages and a fuller appreciation of the specific attributes of this invention will be gained upon an examination of the following drawings, detailed description of preferred embodiments, and appended claims. It is expressly understood that the drawings are for the purpose of illustration and description only, and are not intended as a definition of the limits of the invention.

BRIEF DESCRIPTION OF THE DRAWING(S)

The preferred exemplary embodiment of the present invention will hereinafter be described in conjunction with the appended drawing wherein like designations refer to like elements throughout and in which.

Figure 1:
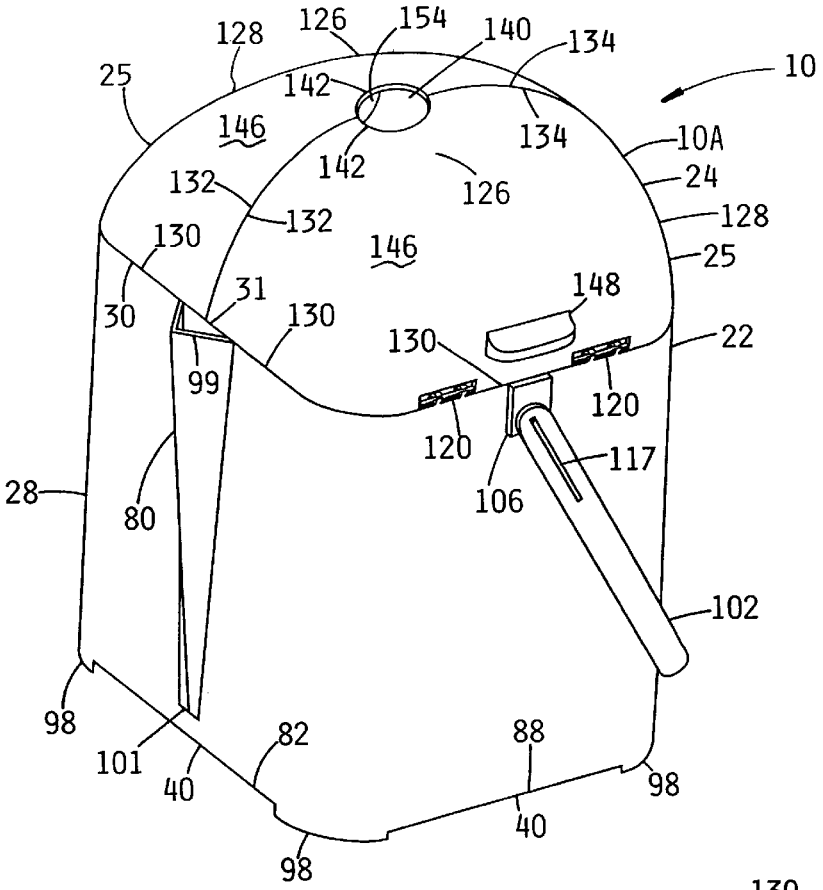
FIG. 1 is a perspective view of the front and side of a first embodiment of the device for storing and cleaning a toilet plunger according to the present invention.
Figure 5:
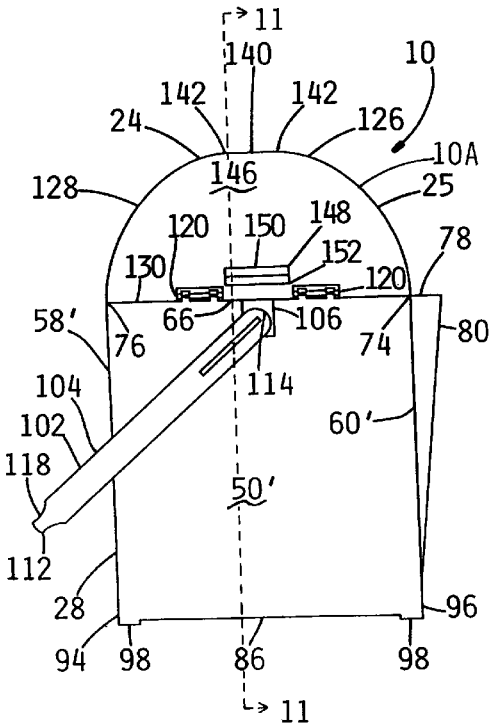
FIG. 5 is a left side view of the device of FIG. 1.
Figure 6:
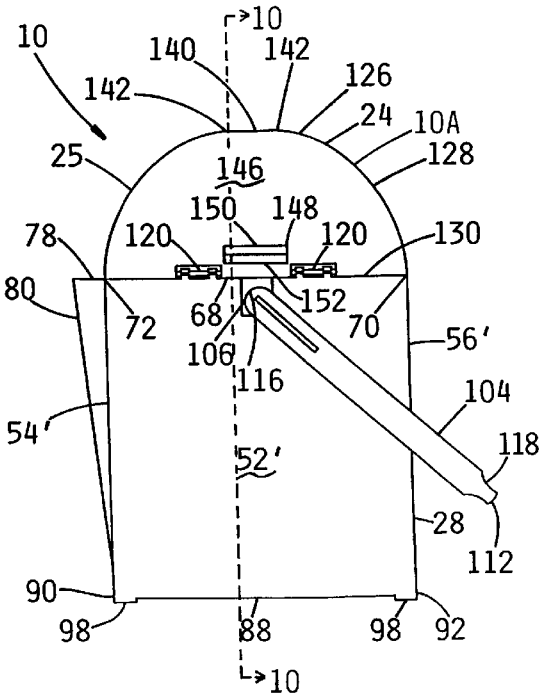
FIG. 6 is a right side view of the device of FIG. 1.
Figure 7:
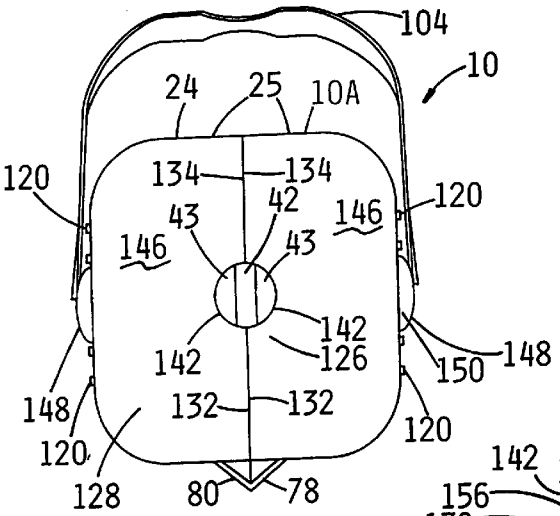
FIG. 7 is a top view of the device of FIG. 1.
Figure 10:
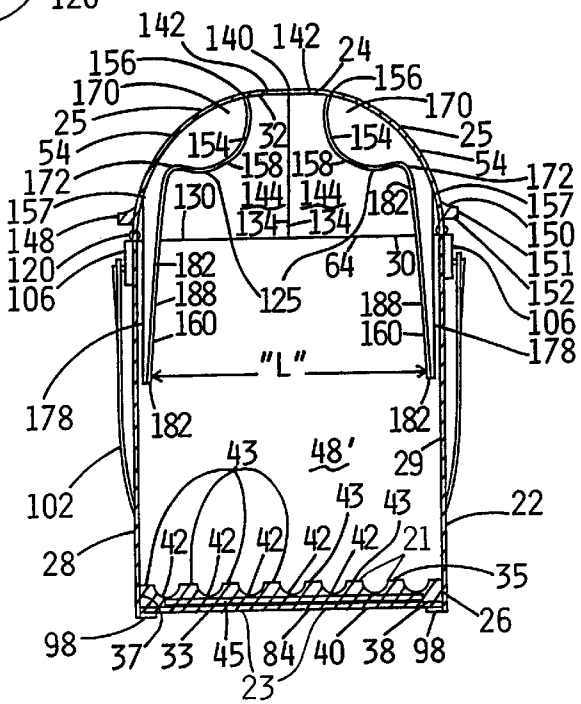
Figure 9:
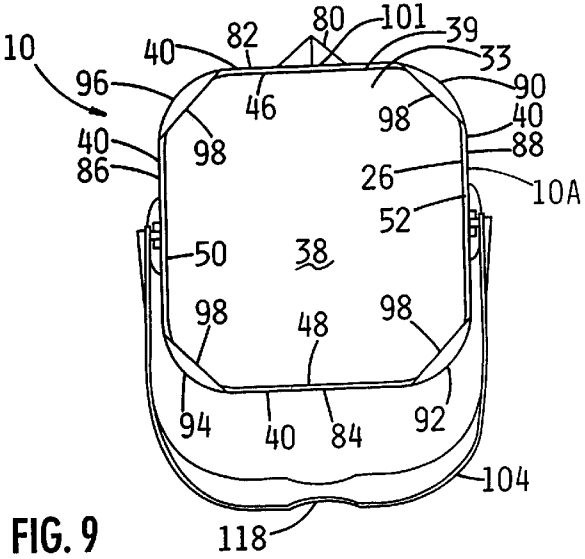
Figure 8A:
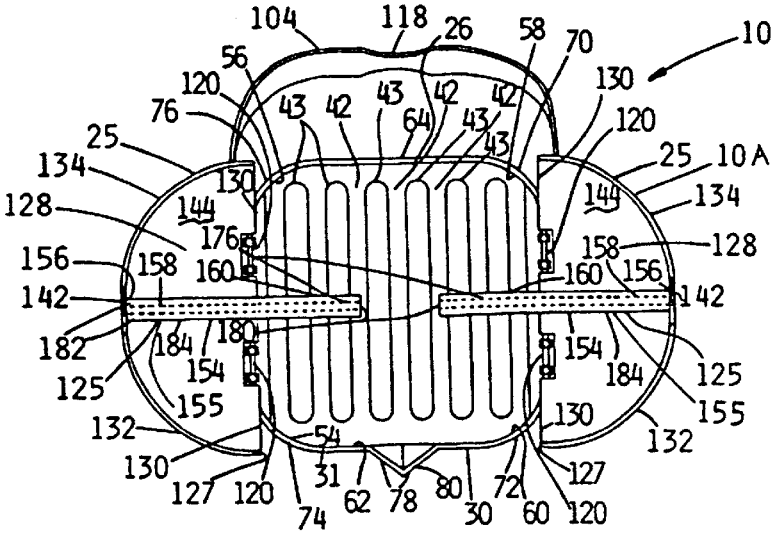
Figure 8B:
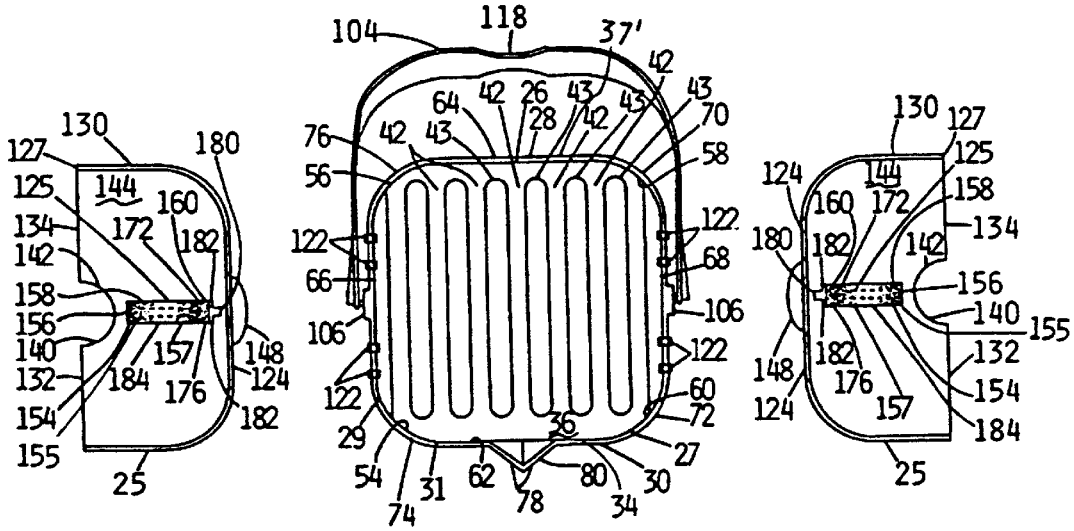
Figure 11:
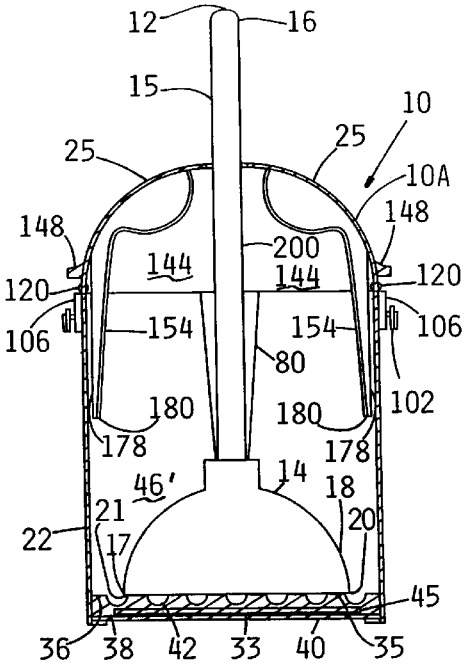
Figure 12A:
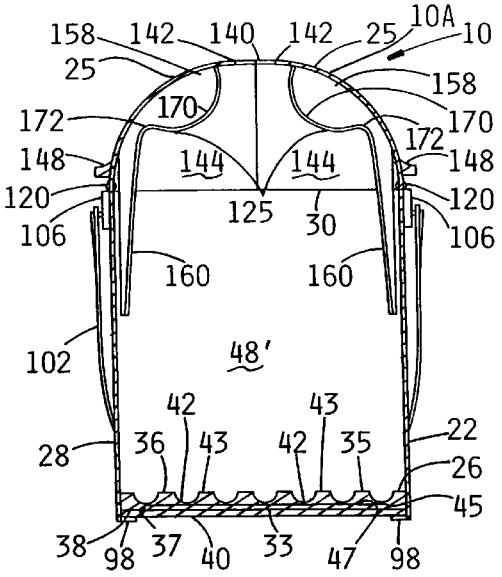
Figure 12B:
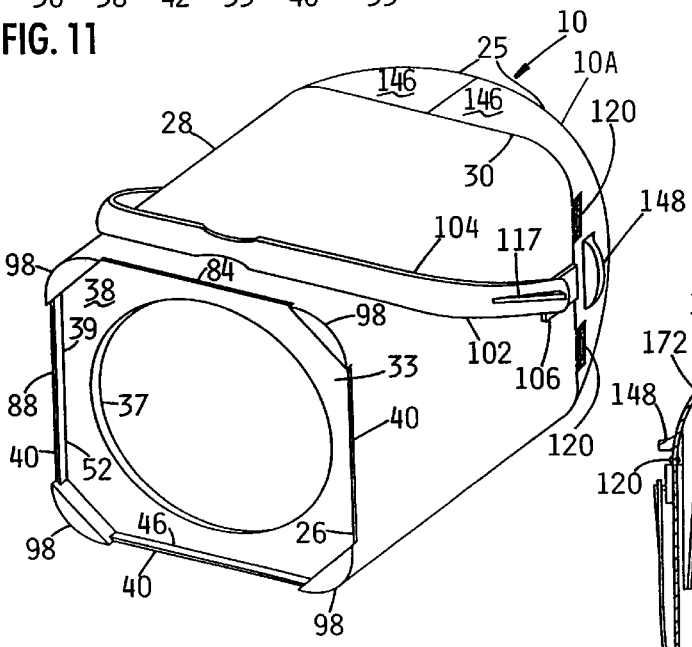
Figure 13:
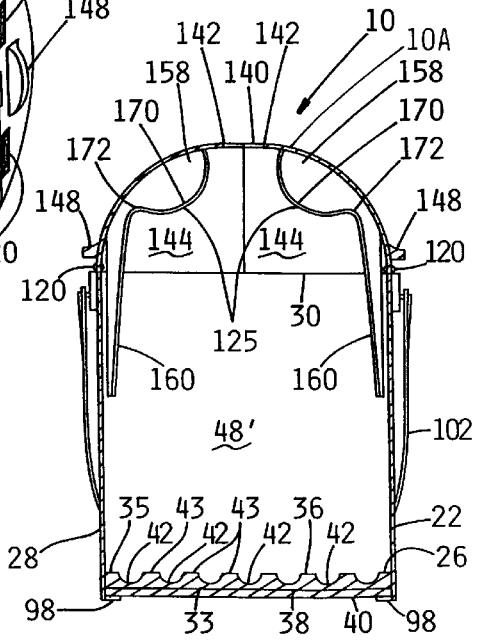
Figure 14:
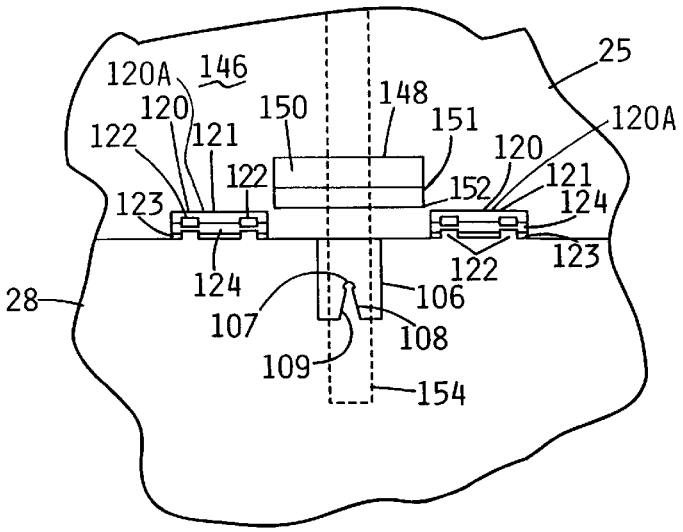
Figure 15:
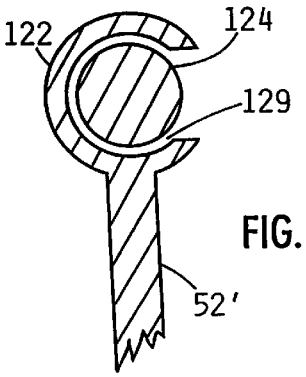
Figure 16:
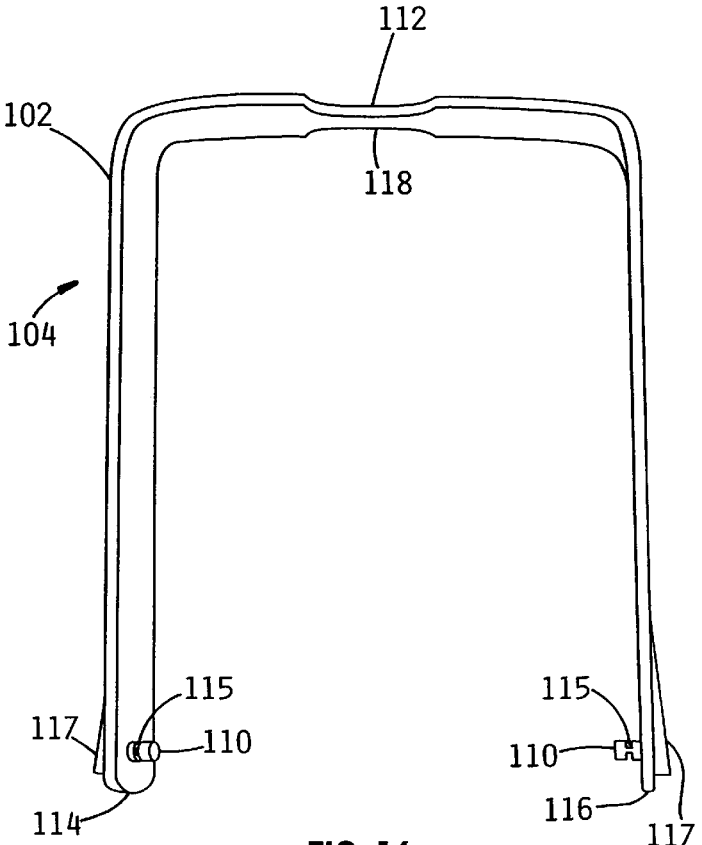
Figure 17:
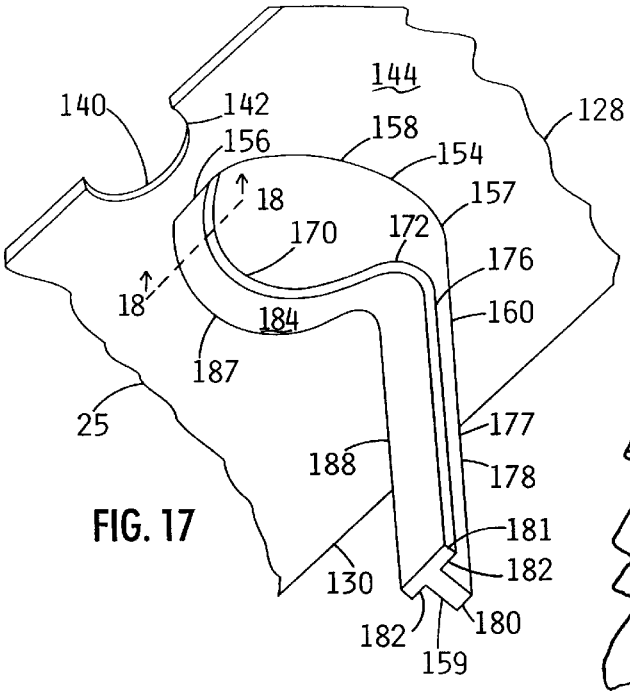
Figure 18:
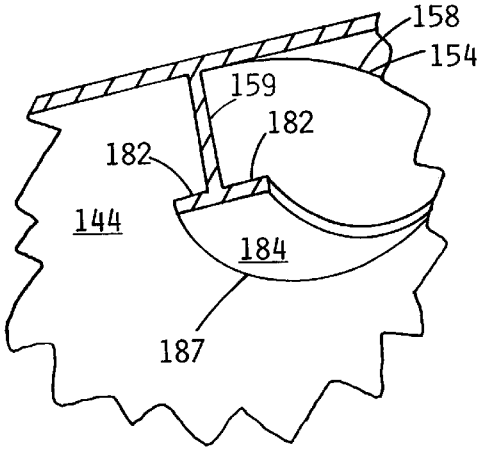
Figure 19:
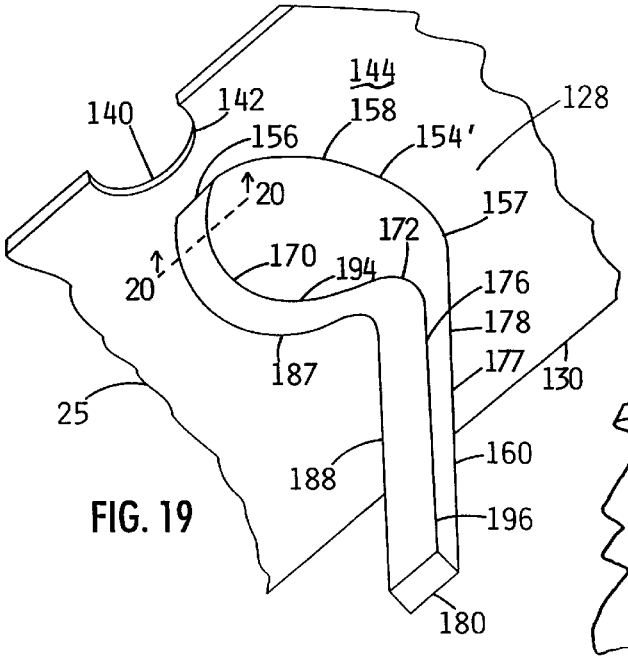
Figure 20:
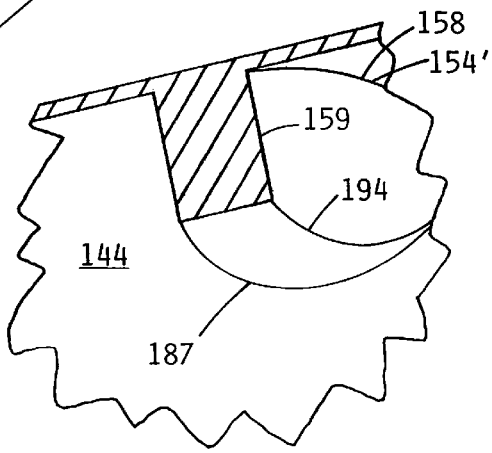
Figure 21A:
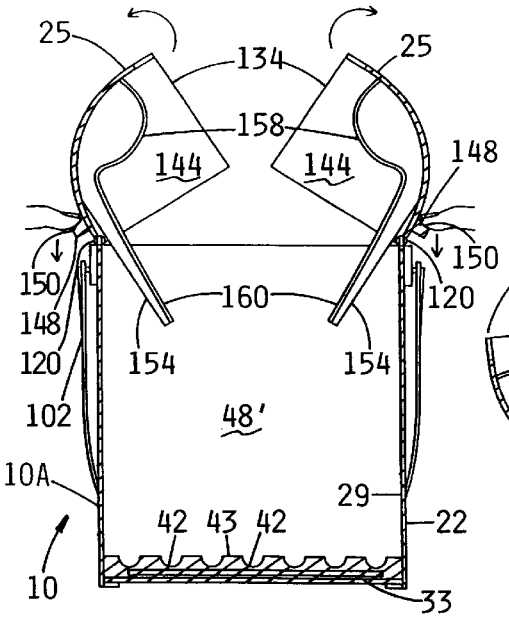
Figure 21B:
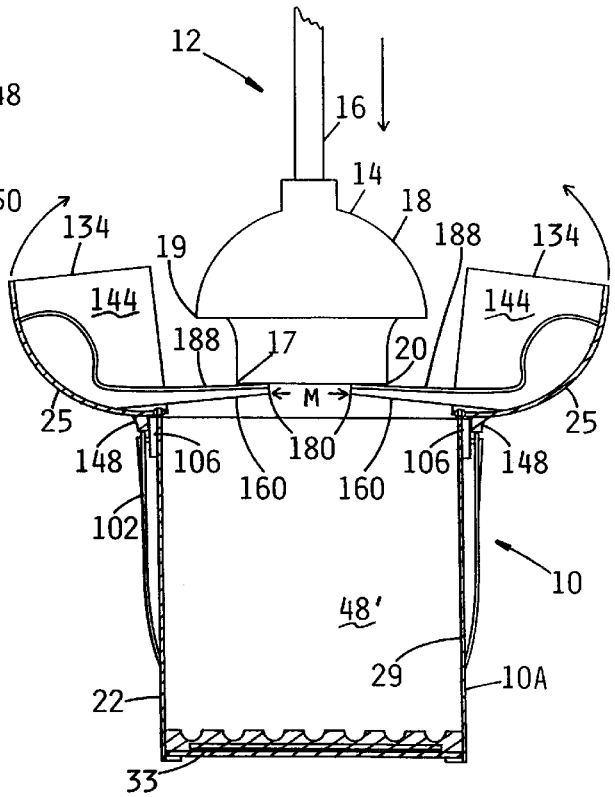
Figure 21C:
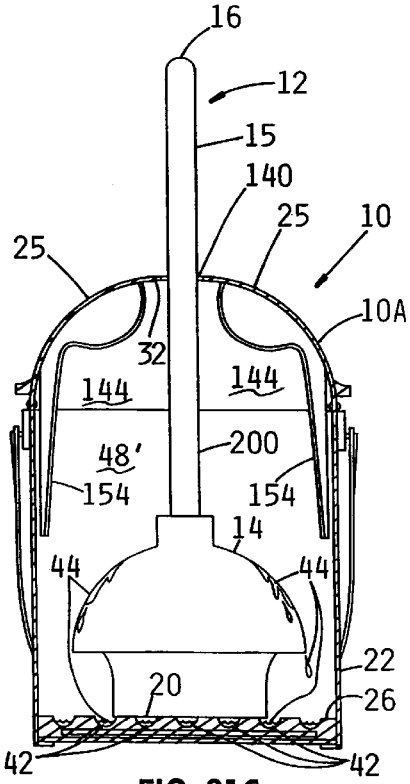
Figure 21D:
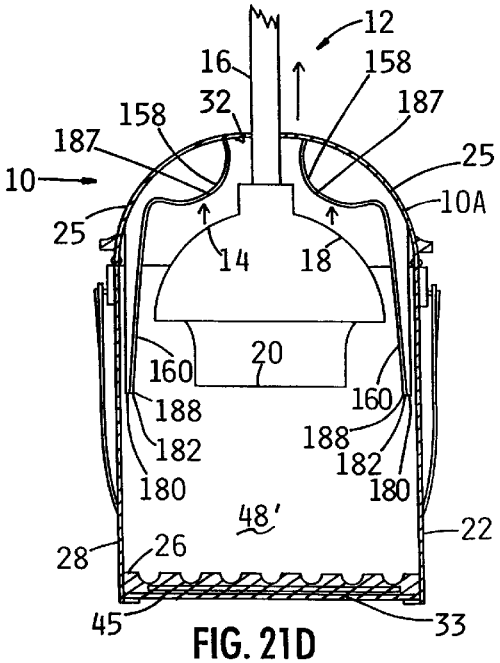
Figure 21E:
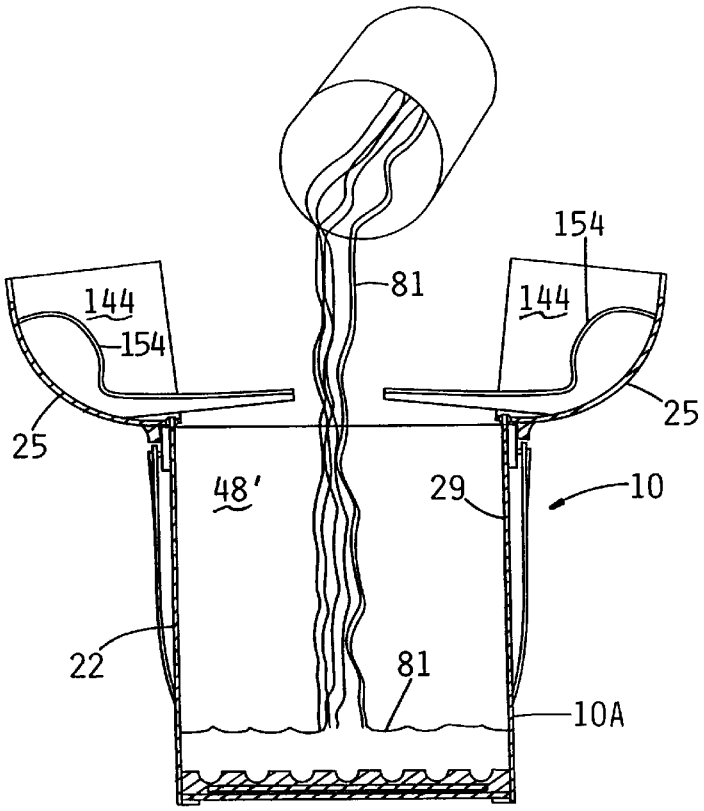
Figure 21F:
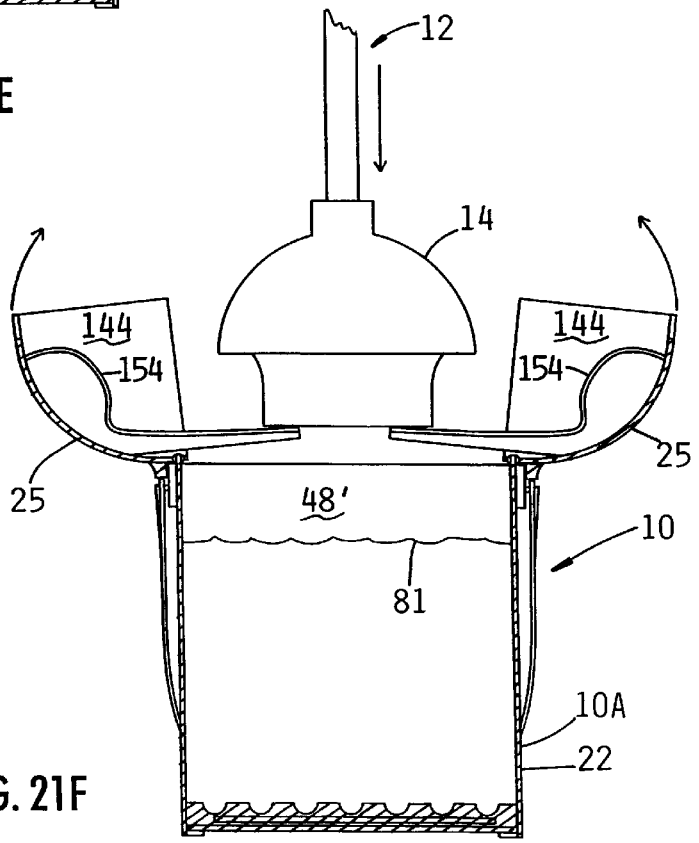
Figure 21G:
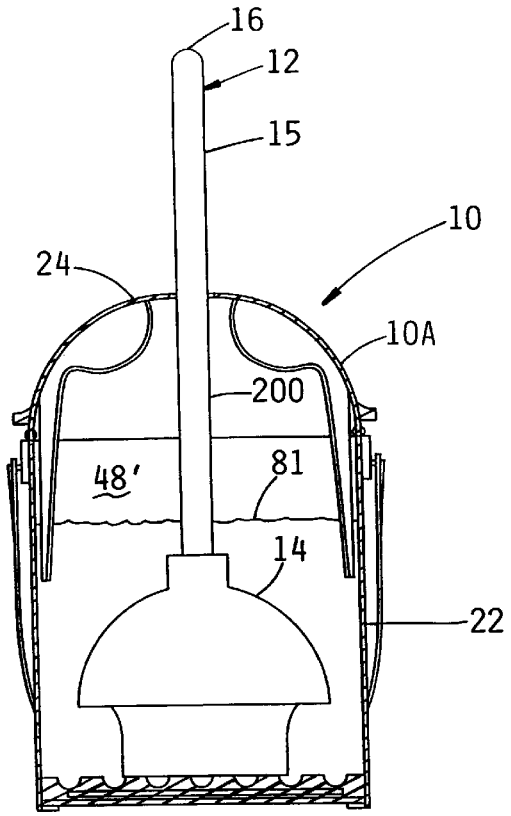
Figure 21H:
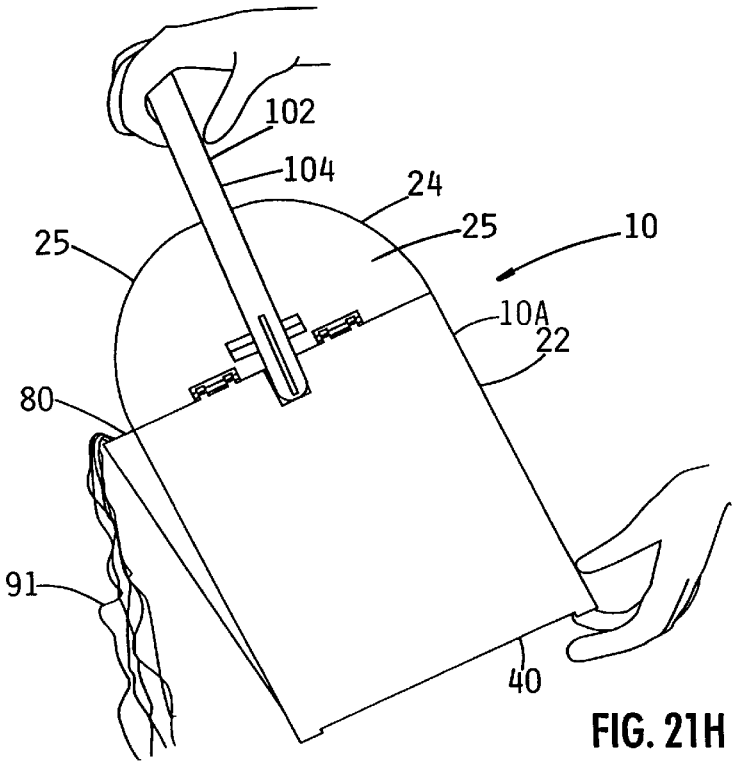
Figure 22:
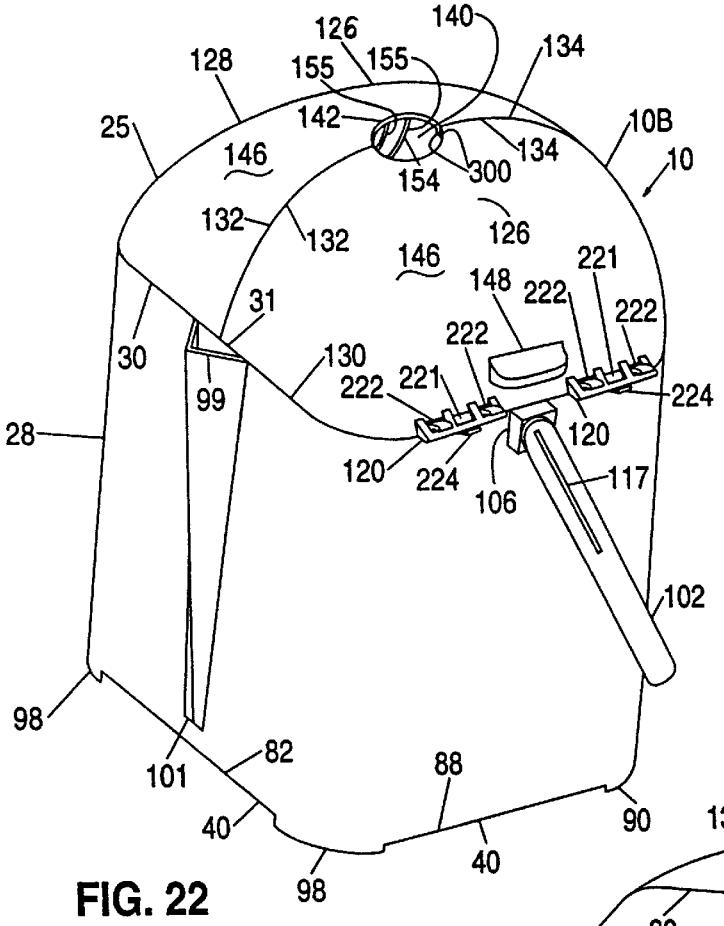
Figure 23:
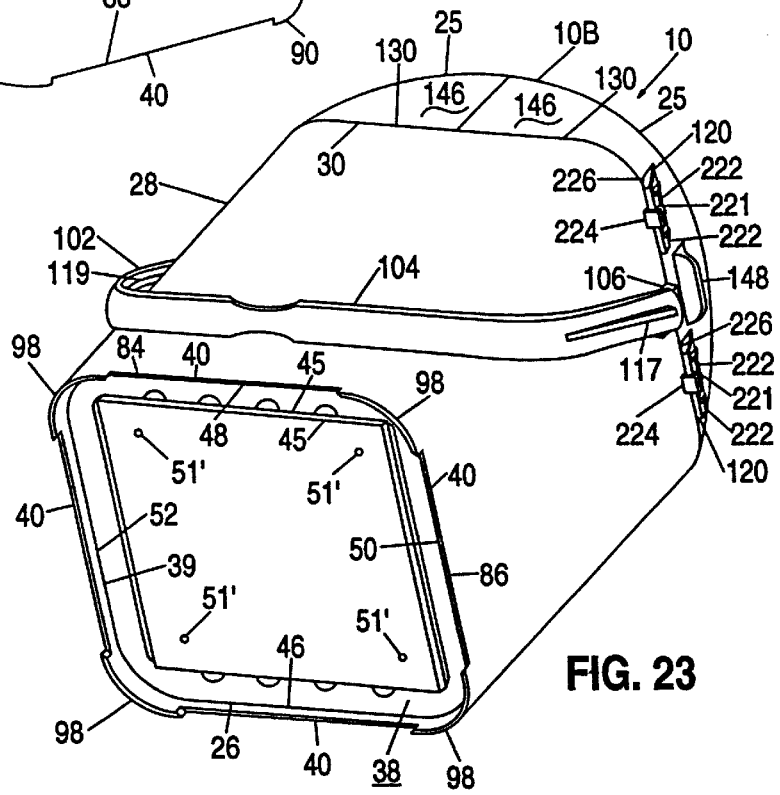
Figure 24:
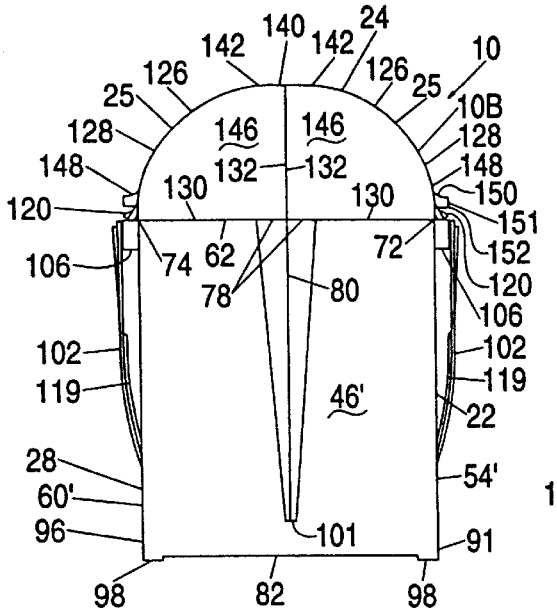
Figure 25:
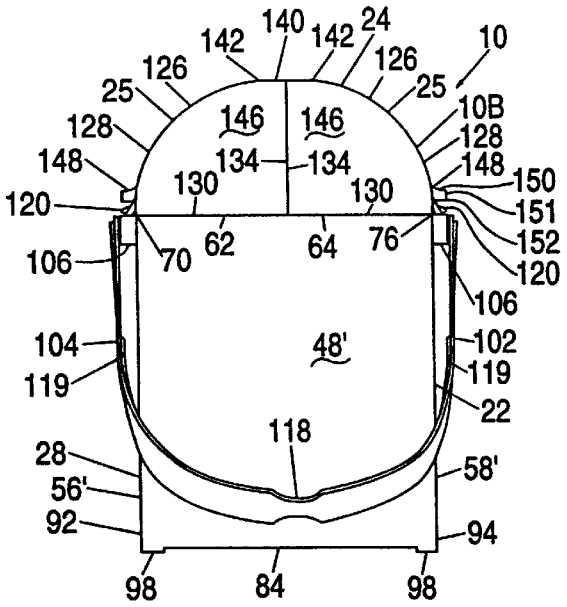

FIG. 8A is a top view of the device of FIG. 1, having the lid-halves open and showing the interior of the container and the interior of the lid-halves including the internal closure mechanism with the closure members having the T-bar construction; and with phantom lines showing the D-shaped curved portion and the inwardly bent portion of the bumper, and the first side of the lever of the closure member;

FIG. 8B is a top view of the device of FIG. 1 with the lid halves detached and removed from the container and oriented to show a top plan view of the interior of each of the lid halves, including the internal closure mechanism with the closure members having the T-bar construction; and with phantom lines showing the D-shaped curved portion and the inwardly bent portion of the bumper, and the first side of the lever of the closure member; the top plan view of the interior of the container is also shown;

FIG. 9 is a bottom view of the device of FIG. 1;

FIG. 10 is a cross-sectional view of the device of FIG. 6, taken along section line 10—10;

FIG. 11 is a schematic broken away cross-sectional view of the device of FIG. 5, taken along section line 11—11, showing a toilet plunger therein;

FIG. 12A is a cross-sectional view of the device as in FIG. 10, shown with an alternate placement of the counterweight;

FIG. 12B is a bottom perspective view of the device of FIG. 12A, without the counterweight, showing the detail of the rim, the recess for placement of the counterweight, the base lower surface and feet;

FIG. 13 is a cross-sectional view of the device as in FIG. 10, shown without the use of a counterweight;

FIG. 14 is an expanded fragmentary view of a lid-half of the device of FIGS. 5 & 6 having the handle detached showing the detail of the hinge mechanism and the handle lug and tab, and showing part of one of the closure mechanisms in phantom lines;

FIG. 15 is an expanded fragmentary side view of the hinge mechanism of FIG. 1;

FIG. 16 is an enlarged view of the detachable handle of the preferred embodiment of the device which has been detached from the container of the device of FIG. 1;

FIG. 17 is an expanded fragmentary interior perspective view of FIG. 1, showing a closure member in one of the lid-halves;

FIG. 18, is an expanded fragmentary section view through a portion of the bumper of FIG. 17 along section line 18—18 and illustrating the T-bar construction of the bumper;

FIG. 19 is an expanded fragmentary interior perspective view of a lid-half showing an alternative embodiment closure member; and FIG. 20, is an fragmentary section view taken through a portion of the bumper of FIG. 19 along section line 20—20 and illustrating the rectangular edge profile construction of the bumper;

FIG. 21A is a schematic broken away cross-sectional view of the device of FIG. 1 taken through section line 10—10 of FIG. 6 showing manual opening of the lid-halves of the device by depressing the tabs downwardly;

FIG. 21B is a schematic broken away cross-sectional view of the device of FIG. 1 taken through section line 10—10 of FIG. 6 showing the mechanical closing of the device using a toilet plunger;

FIG. 21C is a schematic broken away cross-sectional view of the device of FIG. 1 taken through section line 10—10 of FIG. 6 showing a toilet plunger in the stored position and showing fluids draining off the toilet plunger and into the grooves in the base;

FIG. 21D is a schematic broken away cross-sectional view of the device of FIG. 1 taken through section line 10—10 of FIG. 6 showing the mechanical opening of the device using a toilet plunger;

FIG. 21E is a schematic view of the device of FIG. 21B without the toilet plunger showing the pouring of cleaning solution into the open device of the present invention;

FIG. 21F is a schematic view of the device of FIG. 21B showing the closing of the device, which has cleaning solution therein, using the toilet plunger;

FIG. 21G is a schematic view of the device of FIG. 21B showing the device with the toilet plunger soaking in the cleaning solution;

FIG. 21H is a side view of the device of FIG. 1, illustrating gripping the device by the user to drain the device;

FIG. 22 is a perspective view of the front and side of a second embodiment of the device for storing and cleaning a toilet plunger according to the present invention;

FIG. 23 is a bottom perspective view of the rear and side of the device of FIG. 22;

FIG. 24 is a front view of the device of FIG. 22;

FIG. 25 is a rear view of the device of FIG. 22

Figure 26:
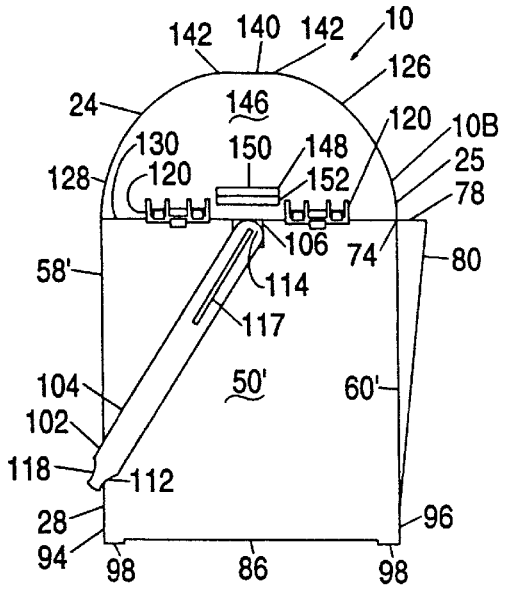
Figure 27:
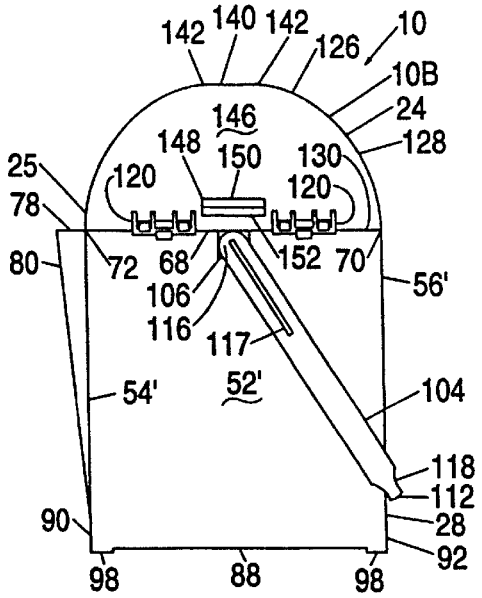
Figure 28:
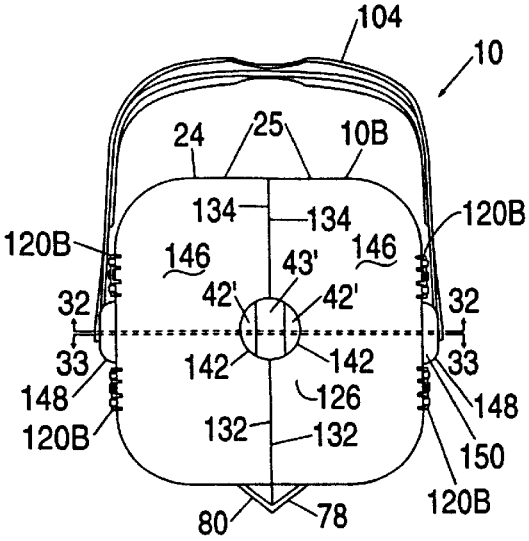
Figure 31:
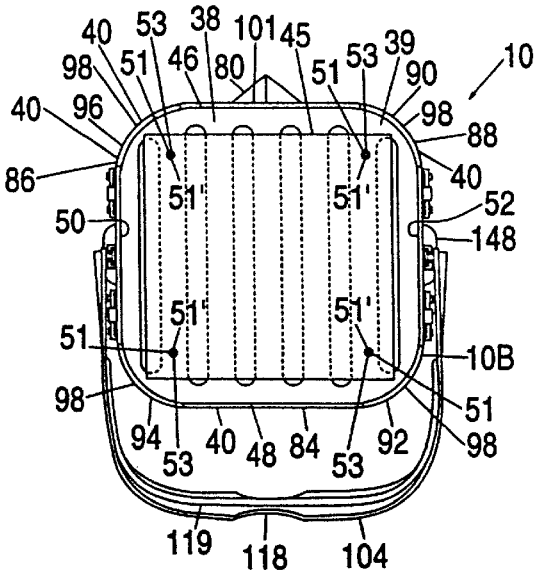
Figure 29:
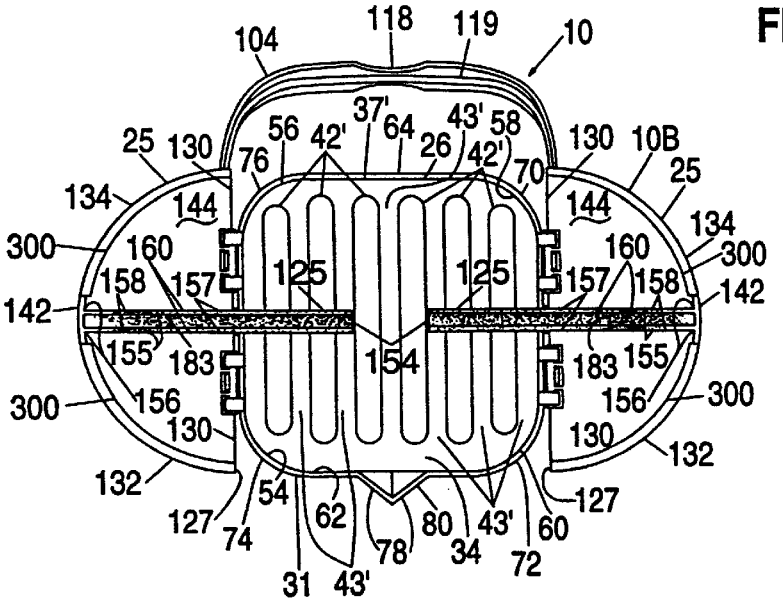
Figure 30:
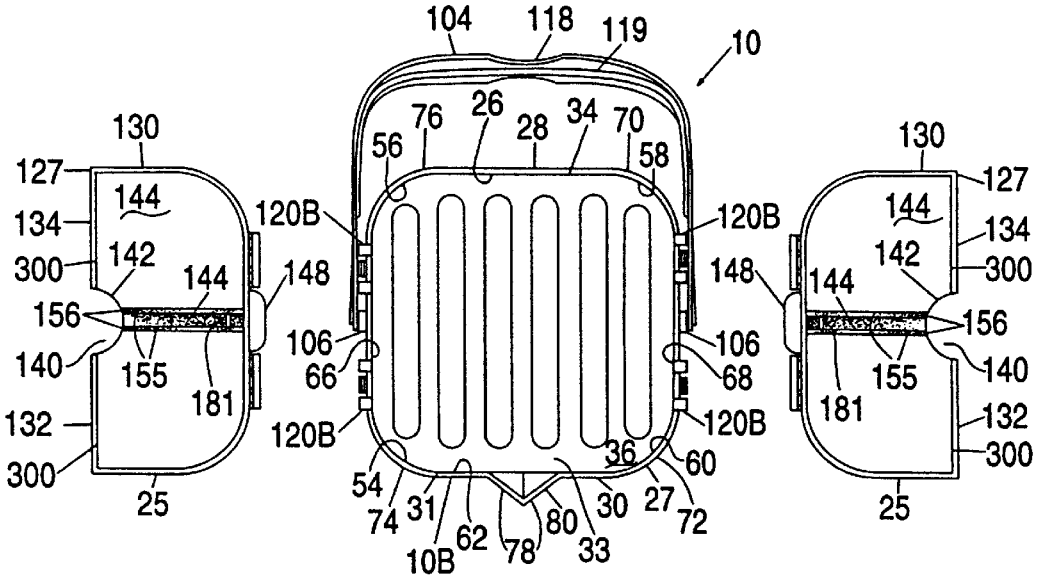
Figure 32:
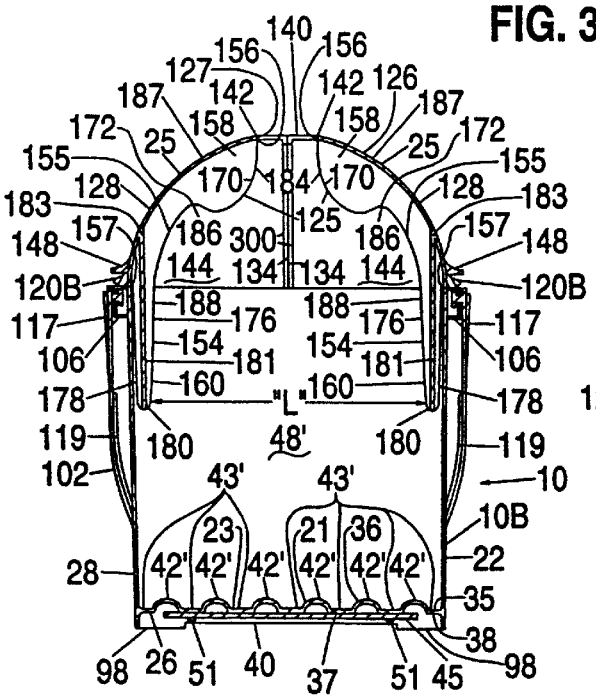
Figure 33:
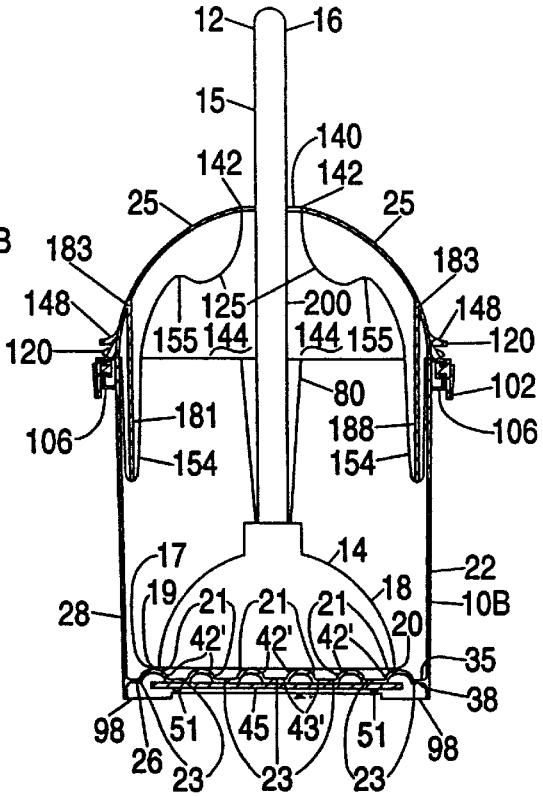
Figure 34:
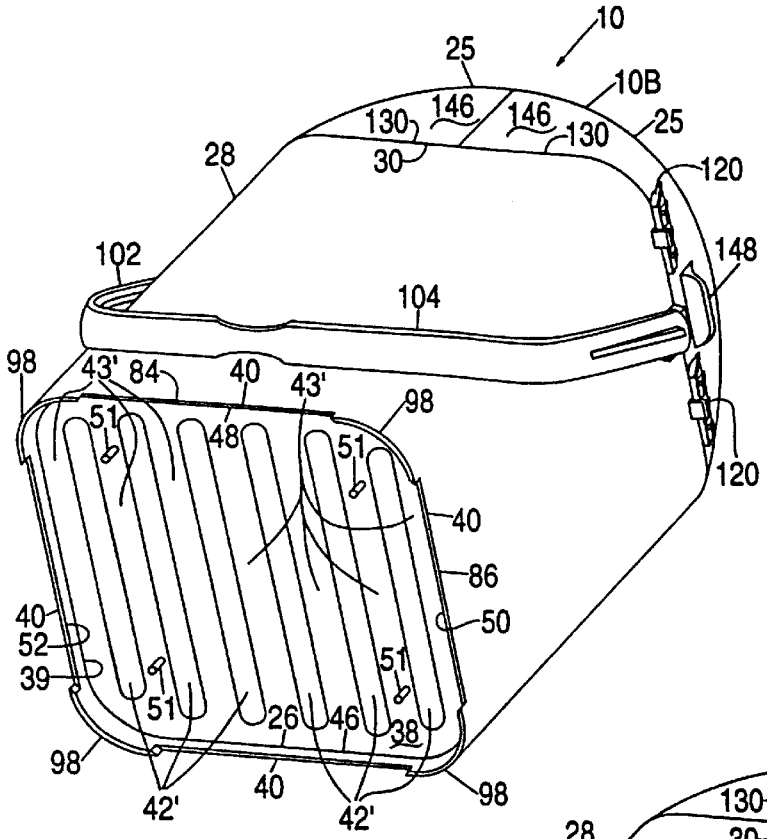
Figure 35:
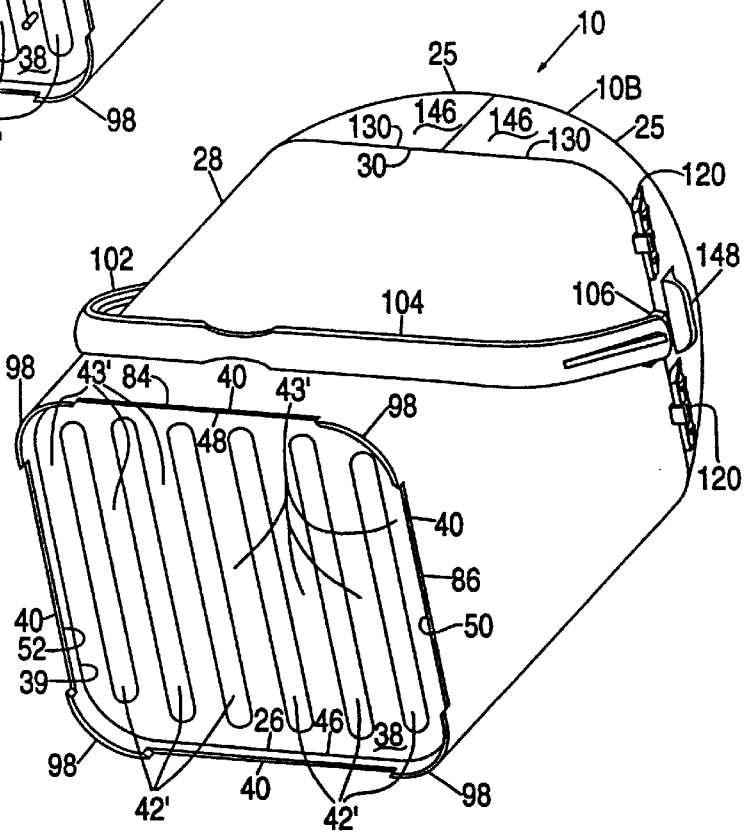
Figure 36:
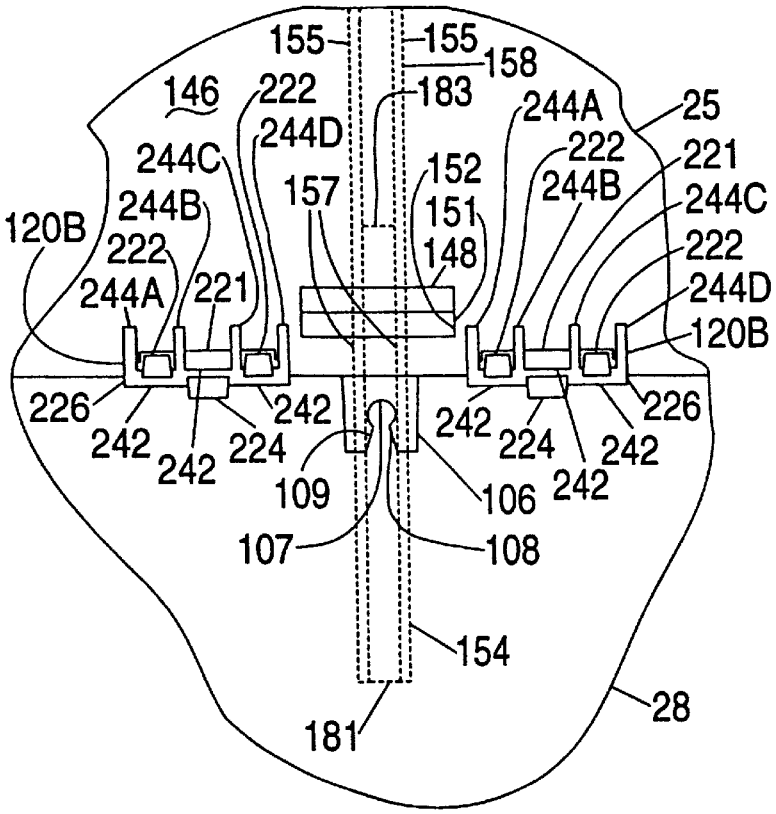
Figure 37:
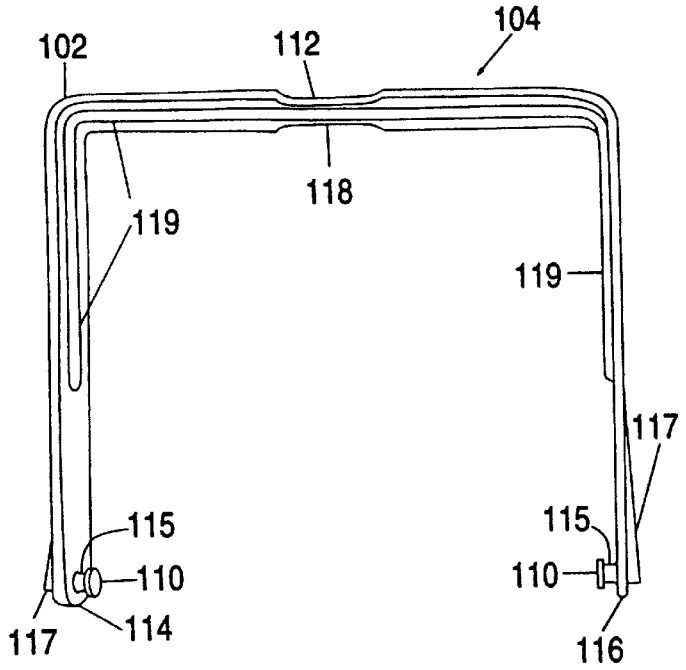
Figure 39A:
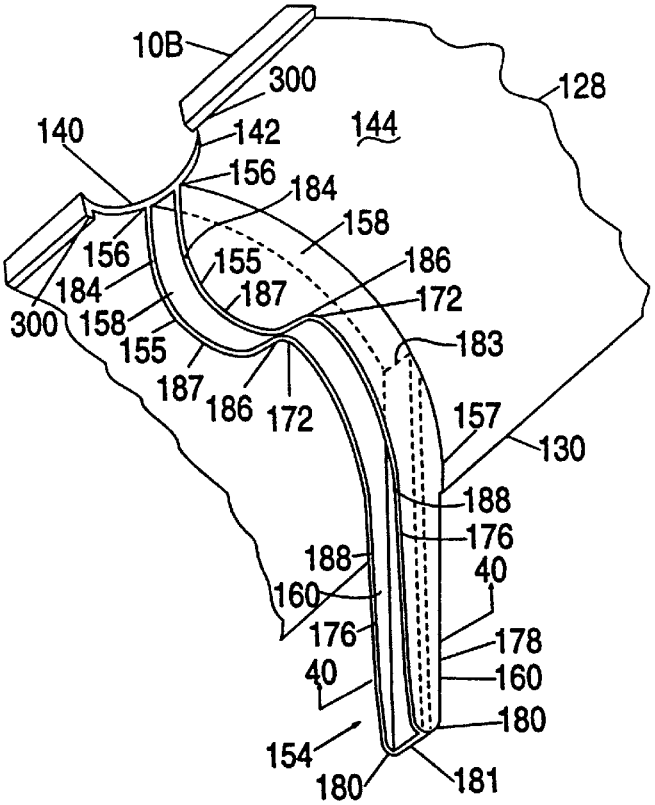
Figure 40:
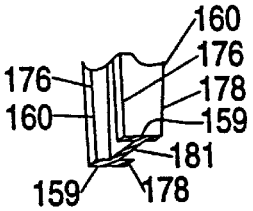
Figure 39B:
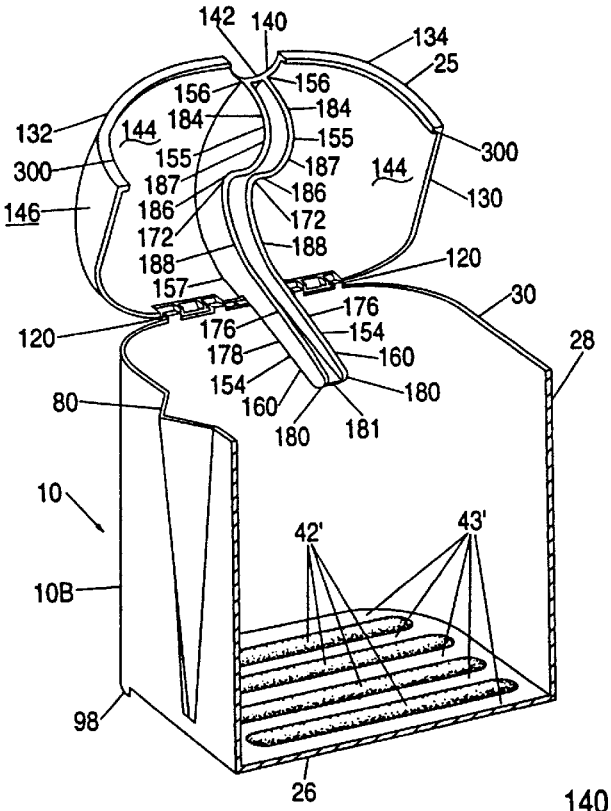
Figure 42:
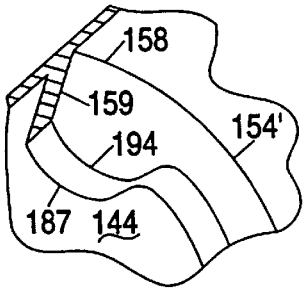
Figure 41:
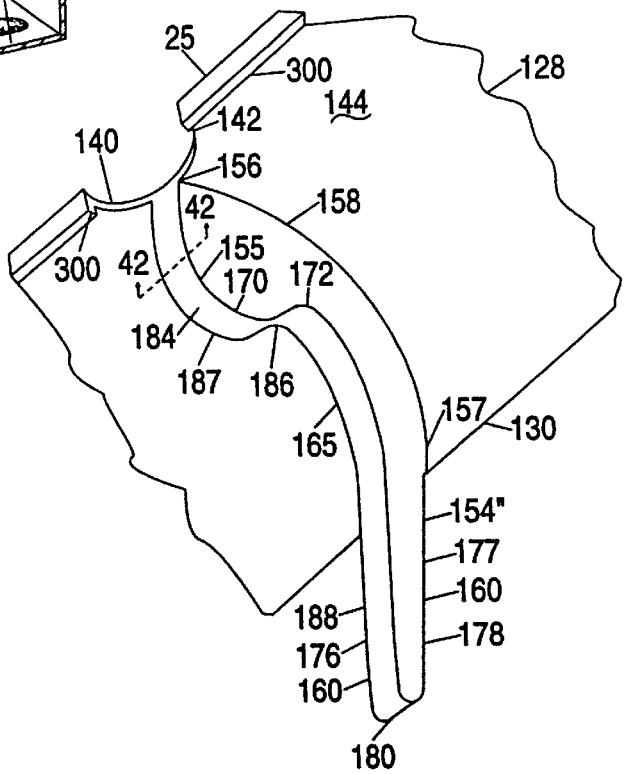
Figure 43A:
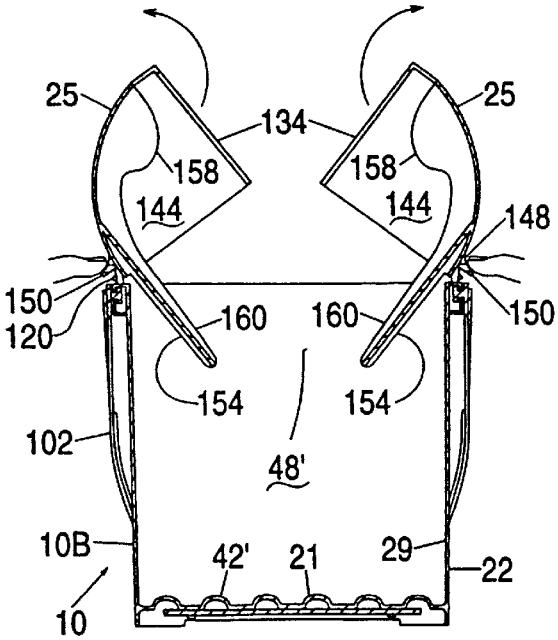
Figure 43C:
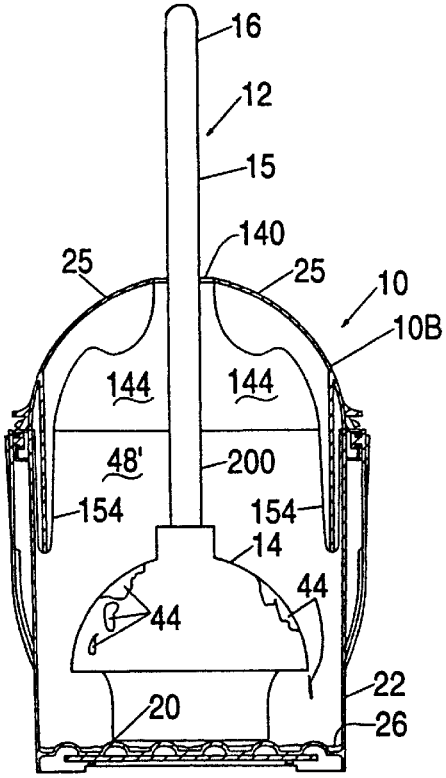
Figure 43B:
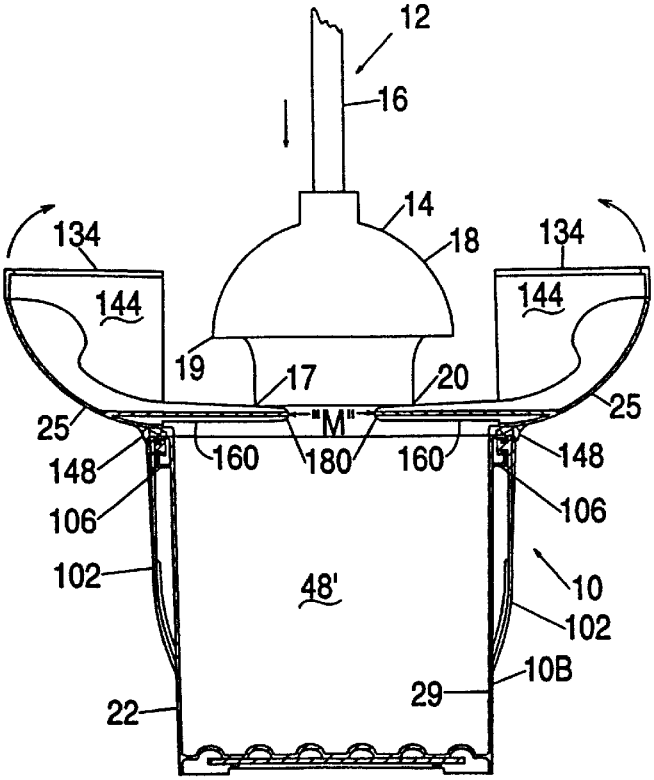
Figure 43D:
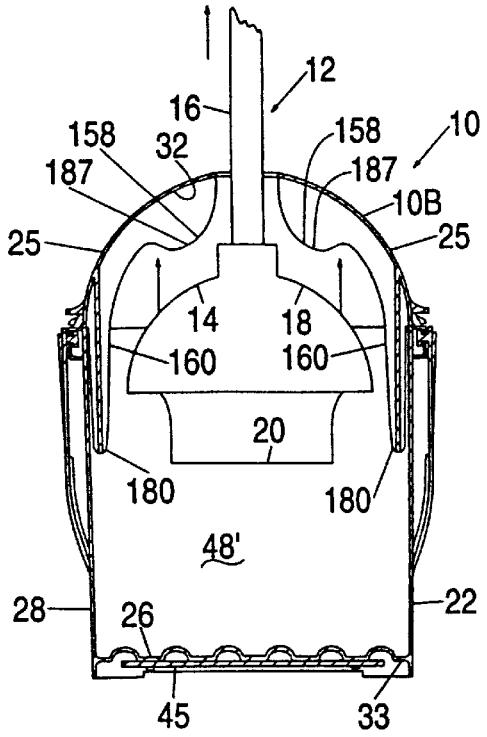
Figure 43E:
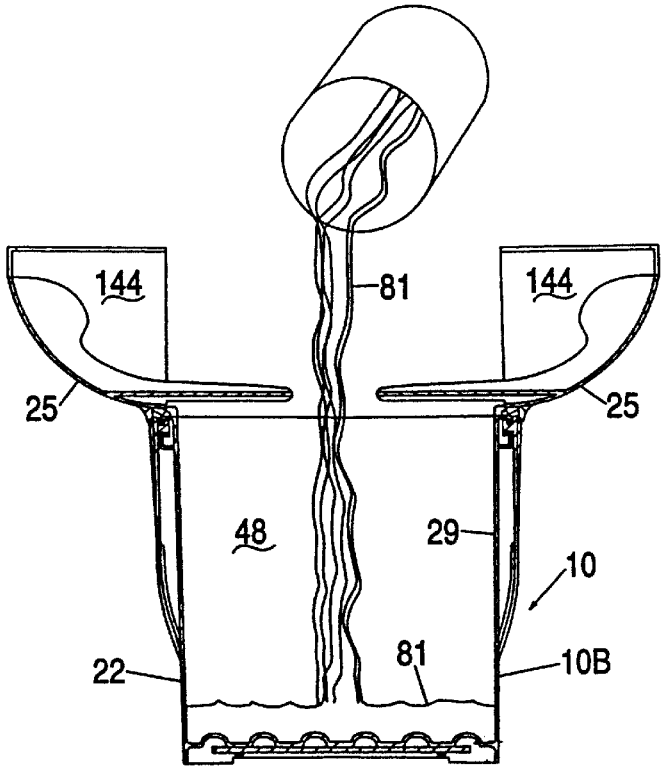
Figure 43F:
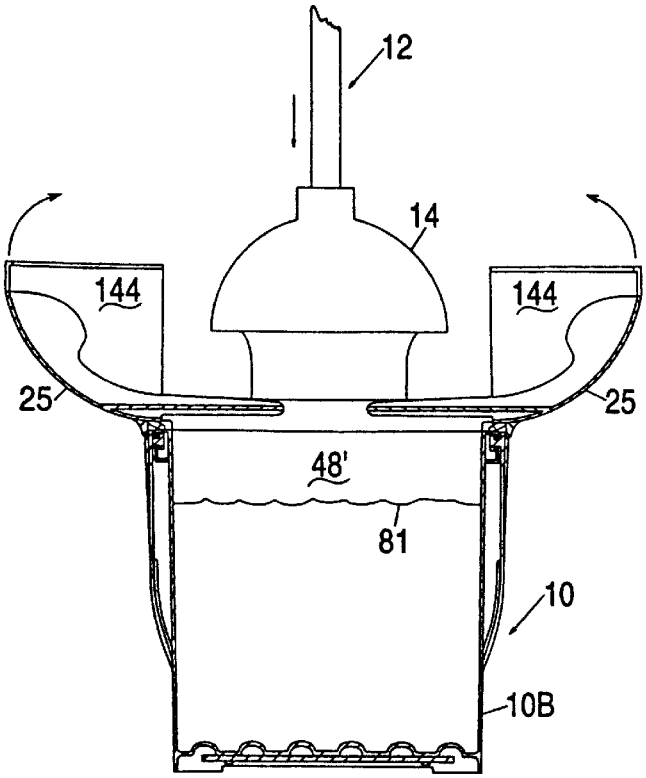
Figure 43G:
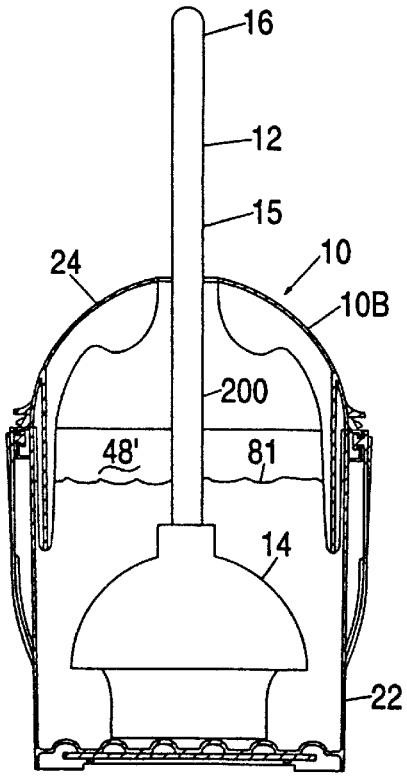
Figure 43H:
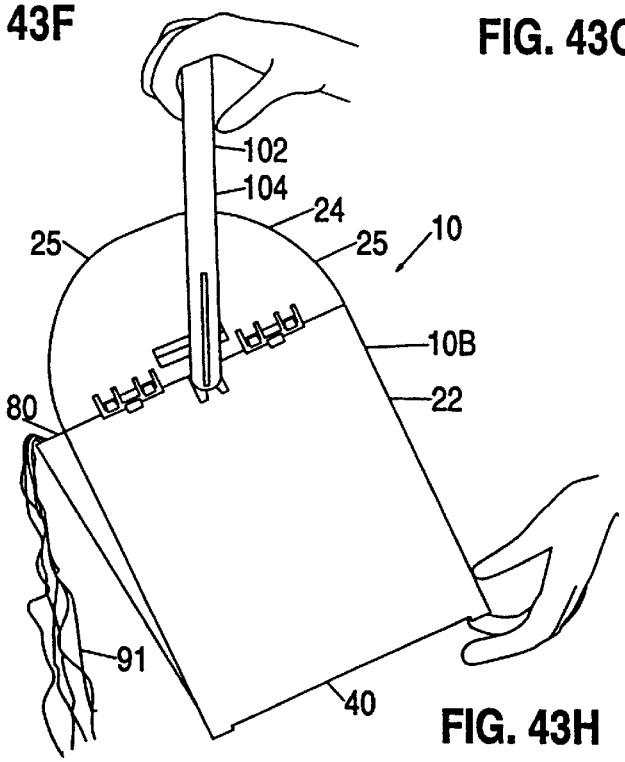

FIG. 26 is a left side view of the device of FIG. 22;

FIG. 27 is a right side view of the device of FIG. 22;

FIG. 28 is a top view of the device of FIG. 22;

FIG. 29 is a top view of the device of FIG. 22, having the lid-halves open and showing the interior of the container and the interior of the lid-halves including the internal closure mechanism with the closure members having the H-shaped construction;

FIG. 30 is a top view of the device of FIG. 22 with the lid halves detached and removed from the container and oriented to show a top plan view of the interior of each of the lid halves, including the internal closure mechanism with the closure members having the H-shaped construction; the top plan view of the interior of the container is also shown;

FIG. 31 is a bottom view of the device of FIG. 22, with the edges of the bottom ridges shown in phantom under the counterweight;

FIG. 32 is a cross-sectional view of the device of FIG. 28, taken along section line 32—32 and bisecting the device;

FIG. 33 is a schematic broken away cross-sectional view of the device of FIG. 28 taken along section line 33—33, showing a toilet plunger therein;

FIG. 34 is a bottom perspective of the rear and side view of the device of FIG. 22, with the counterweight not attached;

FIG. 35 is a bottom perspective of the rear and side view of the device of FIG. 22, made without the counterweight and without stakes;

FIG. 36 is an expanded fragmentary view of a lid-half of the device of FIGS. 26 and 27 having the handle detached showing the detail of the hinge mechanism and the handle lug and tab, and showing part of one of the closure mechanisms in phantom lines;

FIG. 37 is an enlarged view of the detachable handle of the preferred embodiment of the device which has been detached from the container of the device of FIG. 22;

FIGS. 38A–38D are expanded fragmentary cross-sectional side views of the hinge mechanism of FIG. 22 showing in profile a superior hinge cylinder, an inferior hinge cylinder, the engagement of the hinge pin between the superior cylinder and the inferior hinge cylinder, and a portion of the hinge pin, respectively;

FIG. 39A is an expanded fragmentary interior perspective view of FIG. 22, showing a closure member in one of the lid-halves, and showing a portion of one of the bumpers and a portion of the cross member in phantom line;

FIG. 39B is a partial cut away view of the device of FIG. 22 showing one lid-half partially open and the other lid-half removed;

FIG. 40 is an expanded fragmentary section view through a portion of the lever of FIG. 39 along section line 40—40 and illustrating the H-shaped construction of the lever;

FIG. 41 is an expanded fragmentary interior perspective view of a lid-half showing an alternative embodiment closure member; and FIG. 42 is an expanded fragmentary section view taken through a portion of the bumper of FIG. 41 along section line 42—42 and illustrating the rectangular edge profile construction of the bumper;

FIG. 43A is a schematic broken away cross-sectional view of the device of FIG. 22 taken through section line 33—33 of FIG. 28 showing manual opening of the lid-halves of the device by depressing the tabs downwardly;

FIG. 43B is a schematic broken away cross-sectional view of the device of FIG. 22 taken through section line 33—33 of FIG. 28 showing the mechanical closing of the device using a toilet plunger;

FIG. 43C is a schematic broken away cross-sectional view of the device of FIG. 22 taken through section line 33—33 of FIG. 28 showing a toilet plunger in the stored position and showing fluids draining off the toilet plunger and into the lowered portions in the base;

FIG. 43D is a schematic broken away cross-sectional view of the device of FIG. 22 taken through section line 33—33 of FIG. 28 showing the mechanical opening of the device using a toilet plunger;

FIG. 43E is a schematic view of the device of FIG. 43B without the toilet plunger showing the pouring of cleaning solution into the open device of the present invention;

FIG. 43F is a schematic view of the device of FIG. 43B showing the closing of the device, which has cleaning solution therein, using the toilet plunger;

FIG. 43G is a schematic view of the device of FIG. 43B showing the device with the toilet plunger soaking in the cleaning solution; and FIG. 43H is a side view of the device of FIG. 22, illustrating gripping the device by the user to drain the device.

DETAILED DESCRIPTION OF THE INVENTION

The present invention relates broadly to bathroom accessories and in particular, to bathroom accessory storage devices for toilet plungers. However, the present invention is most particularly adapted for use in storing and cleaning a toilet plunger. Accordingly, the present invention will now be described in detail with respect to such endeavors; however, those skilled in the art will appreciate that such a description of the invention is meant to be exemplary only and should not be viewed as limitative on the full scope thereof.

The device of the present invention advantageously permits the user to open and close the device using a toilet plunger without the user touching the soiled plunger cup or the interior of the device. The device of the present invention also permits a wet toilet plunger to drain inside the device, advantageously preventing drainage on the bathroom floor. The drainage is collected within the device and is drained from the device via a pour spout. The device of the present invention is also resistant to tipping when the toilet plunger is removed or inserted into the device as well as when the device is stored, either empty or with a toilet plunger in the device.

The preferred exemplary embodiment of the present invention will hereinafter be described in conjunction with the appended drawing wherein like designations refer to like elements throughout. Reference is initially made to FIGS. 1–43H depicting a bathroom accessory, specifically, a device 10 for storing and cleaning a toilet plunger according to the present invention. The device 10 is illustrated in a first embodiment 10A, shown in FIGS. 1–21H and is best illustrated in a second embodiment 10B, shown in FIGS. 22–43H. The second embodiment 10B is the preferred embodiment of the device 10. Like numbering is used to refer to like elements in each of the two embodiments 10A, 10B.

A conventional toilet plunger 12 has a cup 14 and a handle 16. The toilet plunger handle has two opposite ends. The cup 14 is disposed at one of the ends of the handle 16 with the other opposite end being available for manipulation by the user. The toilet plunger cup 14 has a plunger cup side wall 18 which terminates in a cup end wall 20. The toilet plunger cup 14 has a cup outer diameter 19 and an end wall diameter 17. The cup outer diameter 19 and the end wall diameter 17 may be identical in dimension as illustrated in FIGS. 11 and 33, or the end wall diameter 17 may be smaller than the cup outer diameter 19, as shown in FIGS. 21B–21D and 21F–21G for the first embodiment 10A, and as shown in FIGS. 43B–43D and 43F–43G for the preferred embodiment 10B, as is known in the toilet plunger art. The toilet plunger has an overall length which is measured by a distance extending from the cup end wall 20 to the end of the handle 16 which is available for manipulation by the user.

The device 10, as shown in embodiments 10A, 10B, includes an open-topped container 22 and an upper lid 24 resting on and covering the open-topped container 22. The lid 24 has two lid-halves 25. The container 22 is suitably dimensioned to be a plunger-receiving container with the plunger 12 resting within the container 22 and with a protruding portion 15 of the plunger handle 16 protruding through the lid 24, as illustrated in FIGS. 11, 21C and 21G for the first embodiment 10A and in FIGS. 33, 43C and 43G for the second embodiment 10B.

The device 10 of the present invention is suitably made of plastic materials, such as, but not limited to high impact co-polymer polypropylene, using an injection mold process. However, the device 10 may also be made of a variety of other plastics or metals. Most preferably the lid 24 and container 22 are made of high impact co-polymer polypropylene, available from Solvay Corp., of Houston, Tex.

For each of the embodiments 10A, 10B of device 10, the open-topped container 22 has a base 26 having upstanding container side walls 28 which terminate in an upper perimeter wall edge 30 which forms an opening 31 of the open-topped container 22. The container walls 28 have a wall thickness 27. The container 22 has an interior 29 formed by the container walls 28 and the base 26. The device 10 has an interior 32 formed by the lid 24, the container walls 28 and the base 26. The base 26 has a base top 35 with a top surface 36, an opposite base bottom 33 with a bottom surface 38 and a base peripheral edge 39. The base top surface 36 and the base bottom surface 38 are opposing. The base has a base thickness 37, i.e., the dimension between the top surface 36 and the bottom surface 38. The base top surface 36 is oriented toward the interior 29 of the container 22. The base 26 also has a lower peripheral rim 40 which extends downwardly from the base 26 and is integral with the upstanding walls 28. The base has contiguous raised portions 21 and lowered portions 23 therein. The raised portions 21 of the base act as a stable surface or platform for the cup end wall 20 of the plunger 12 to rest upon. The lowered portions 23 of the base 26 function to collect any liquids draining off the toilet plunger cup 14. The base 26 has a front portion 34 and a back(rear) portion 37'.

In the first embodiment 10A, as best shown in FIGS. 8A, 8B and, 10–12A, 13, 21A–21G, the base top 35 of base 26 has a plurality of base grooves 42 therein. The grooves 42 are the lowered portions 23 of the base 26. The grooves 42 are disposed downwardly away from the opening 31 of the open-topped container 22. Between the grooves 42 are the raised portions 21 of the base 26; these are base flat portions 43. Each of the base flat portions 43 is preferably elongated in shape with curved ends, although other shapes may be used. As best shown in FIGS. 11, 21C and 21G, the base flat portions 43 form the generally flat base top 35 which advantageously provides a stable surface for the cup end wall 20 of the toilet plunger 12 to rest upon. Advantageously, any fluids 44 draining off the toilet plunger cup 14 may be collected in the grooves 42. The grooves 42 all connect at the front portion 34 and the back portion 37' of the base 26, so that fluids 44 will pool there and readily drain to the front of the device 10 and out of a pour spout 80 when the device 10 is tipped for pouring. In the first embodiment 10A, the opposite bottom surface 38 of the base 26 is preferably flat.

In the second embodiment 10B of the device 10 of present invention, as best shown in FIGS. 29–30, 32–33 and 43A–43G, the base 26 is preferably ridged. The base 26 has a plurality of base ridges 42' therein which form the raised portions 21 of the base 26. The base ridges 42' are disposed upwardly toward the opening 31 of the open-topped container 22. Each of the base ridges 42' is preferably elongate in shape with curved ends, although other shapes may be used. As best shown in FIGS. 33 and 43C, the base ridges 42' form a platform which advantageously provides a stable surface for the cup end wall 20 of the toilet plunger 12 to rest upon. Between the base ridges 42' are the lowered portions 23 of the base 26. In the second embodiment 10B, the lowered portions 23 form flat base portions 43' which in effect form channels between the ridges. Advantageously, any fluids 44 draining off the toilet plunger cup may be collected in the lowered flat base portions 43'. The base top 35 has base ridges 42' alternating with the lowered flat base portions 43'. In the preferred embodiment 10B, the opposite bottom surface 38 of the base follows the same contours as the base top 35. All portions of the base top 35 are contiguous so that fluids 44 will pool in the lowered flat base portions 43' and readily drain to the front of the device 10 and out of the pour spout 80 when the device is tipped for pouring. In the preferred embodiment 10B, plastic stakes 51 project downwardly(away from the opening 31 of the open-topped container 22) from the bottom surface 38 of the base 26. FIG. 34 is a bottom perspective view of the second embodiment 10B of the device 10 showing the stakes 51.

Preferably, a counterweight 45 is used in each of the embodiments 10A, 10B of the device 10. The counterweight 45 advantageously prevents tipping of the device 10 when the toilet plunger 12 is removed from the device 10, when the device 10 is used to store the toilet plunger 12 and when the device 10 is empty. The counterweight 45 is suitably approximately 1 to 1.5 pounds (454 to 681 grams) in mass and is made of materials, such as, but not limited to, anodized steel, granite, marble, marble-like plastics such as CORIAN™ (commercially available from DuPont of Wilmington, Delaware).

Figure 2:
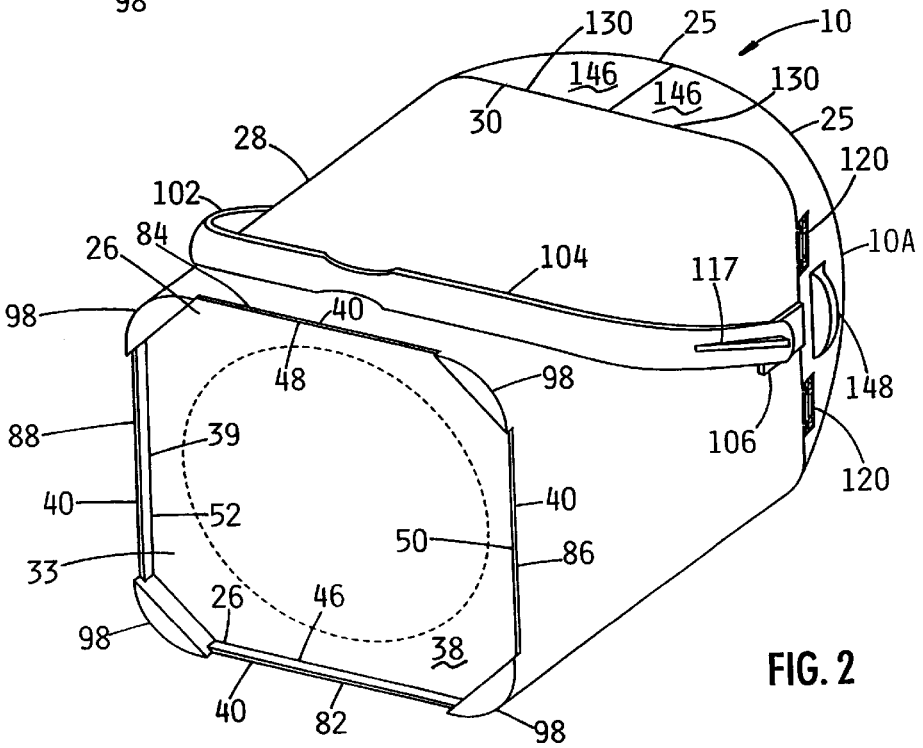
FIG. 2 is a bottom perspective view of the rear and side of the device of FIG. 1 with phantom lines showing the position of the counterweight.

In the first embodiment 10A, as shown in FIGS. 10,11, and 12A the counterweight 45 is disposed in the device 10 under the top surface 36 and below grooves 42. FIG. 2 is a bottom perspective view of the device of FIG. 1, with the counterweight 45 shown in phantom lines to illustrate the position of the counterweight 45 in the base 26. The counterweight 45 is preferably molded into the device when the device 10 is injection molded and is preferably disposed between the top surface 36 and the bottom surface 38 of the base 26. The counterweight 45 is preferably a one pound circular sheet of ⅛ inch anodized steel, commercially available from Exel Tool & Molding of Elroy, Wisconsin.

Alternatively, for the first embodiment 10A of the device 10, as shown in FIGS. 12A and 12B, the counterweight 45 may be affixed to a recess 37" in the bottom surface 38 of the base 26 of the device 10 in a conventional matter, such as by gluing, cementing, sonic welding, etc. The recess 37" is suitably dimensioned to accept the counterweight 45. The counterweight 45 is affixed to the base 26 by applying a layer 47 of adhesive, preferably a water proof cement, such as 3M ALL PURPOSE INDUSTRIAL ADHESIVE, commercially available from 3M Corp. of St. Paul, Minn. to the recess 37" and then placing the counterweight 45 onto the adhesive layer 47. Still, alternatively, the first embodiment 10A of the device 10 may be manufactured and used without a counterweight as shown in FIG. 13. All other aspects of the invention, as shown in FIGS. 12A–12B and 13, are identical to the first embodiment 10A as shown and described in FIG. 1 and herein throughout. Preferably in the second embodiment 10B of the device 10, as best shown in FIGS. 23, 31–32, the counterweight 45 is disposed under the top surface 36 of the base 26 and adjacent to the bottom surface 38. The counterweight 45 has apertures 53 therethrough. Each of the apertures 53 is suitably dimensioned to engagingly accept one of the stakes 51 of the base 26. The counterweight 45 is snapped into place by aligning each of the respective apertures 53 with a respective stake 51 and then pressing the counterweight 45 toward the bottom surface 38 of the device 10. An end of each of the stakes 51 protrudes through the counterweight 45. These protruding ends of stakes 51 are then sonically melted to form a flattened head 51' that is larger than aperture 53, thus permanently securing counterweight 45 to the device 10. The counterweight 45 is preferably a one pound square sheet of ⅛ inch powder-coated or anodized steel, commercially available from Exel Tool & Molding of Elroy, Wis. Alternatively, the second embodiment 10B of the device 10 may be manufactured and used without the stakes 51 and without the apertures 53 in the counterweight 45, and instead the counterweight 45 may be affixed to the bottom surface 38 of the base 26 in a conventional manner, as is known in the art, for example, by gluing, cementing, sonic welding, etc., of the counterweight 45 to the bottom surface 38 of the base 26. Yet alternatively, the second embodiment 10B of the device 10 may be manufactured and used without the counterweight 45, and with or without the stakes 51 as shown in FIGS. 34 and 35, respectively. All other aspects of the invention, as shown in FIGS. 34 and 35 are identical to the preferred embodiment as shown and described in FIGS. 22–33 and 36–43H.

To better illustrate the base 26 and upstanding walls 28, reference is made to FIGS. 1–6, 8A, 8B and 9 for the first embodiment 10A and to FIGS. 22–27 and 29–35 for the second embodiment 10B. The base 26 is preferably generally square in shape having curved corners. Thus, the base peripheral edge 39 has four linear sides (base front side 46, base rear side 48, base left side 50 and base right side 52) and four curved base corners 54, 56, 58, 60. A curved base corner is disposed between each pair of linear base sides. Walls 28 extend upwardly from the base sides 46, 48, 50, 52 and curved base corners 54, 56, 58, 60 of the base peripheral edge 39 and are integral with each other and with the base 26. Thus, a front wall 46' extends from base front side 46; a rear wall 48' extends from base rear side 48; a left side wall 50' extends from base left side 50; a right side wall 52' extends from right side wall 52; and curved corner walls 54', 56', 58', and 60' extend from base curved corners 54, 56, 58 and 60, respectively. Collectively, container walls 46', 48', 50', 52' 54', 56', 58', 60' are referred to as walls 28. The upper perimeter wall edge 30 of the walls 28 generally repeat the shape of the base 26, having linear upper perimeter side portions (front 62, rear 64, left 66, and right 68) interconnected by four curved upper perimeter corner portions 70, 72, 74, 76. Upper perimeter front side portion 62 has a perimeter projection 78 for a pour spout 80, as best illustrated in FIGS. 8B and 30, and described in detail hereinafter. Advantageously, the preferred curved corner walls 54', 56', 58', 60' make the device easier to clean because there are no sharp angled corner walls to which semi-solid materials from a soiled plunger may adhere.

In both embodiments 10A, 10B of the device 10, the lower peripheral rim 40 extends downwardly from the base peripheral edge 39 and away from the opening 31 of container 22. Rim 40 is integral and continuous with walls 28. The rim 40 has four linear sides (rim front side 82, rim rear side 84, rim left side 86, rim right side 88) and four curved rim corners 90, 92, 94, and 96. A rim corner is disposed between each pair of linear rim sides. Feet 98 extend from the rim 40 at each of the curved rim corners 90, 92, 94, and 96 of the base 26. The feet 98 provide additional stability to the container 22 and elevate the rim 40 of the container 22 above a surface (not shown) upon which the device 10 is placed, advantageously providing air circulation under the device 10 to diminish any moisture accumulation there.

Figure 3:
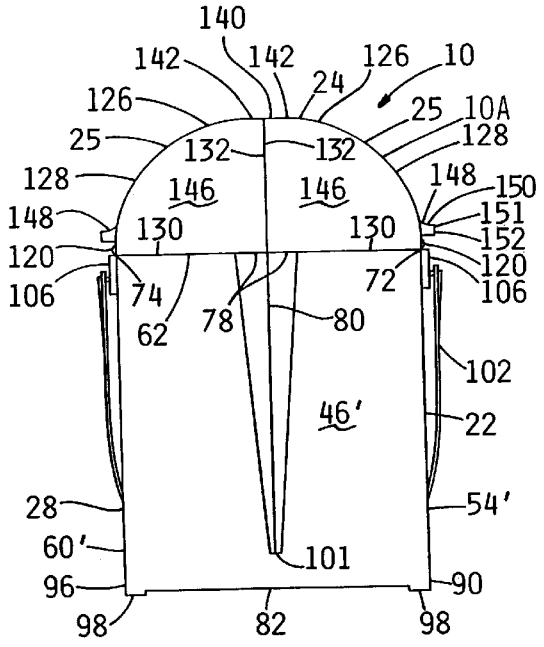
FIG. 3 is a front view of the device of FIG. 1.
Figure 4:
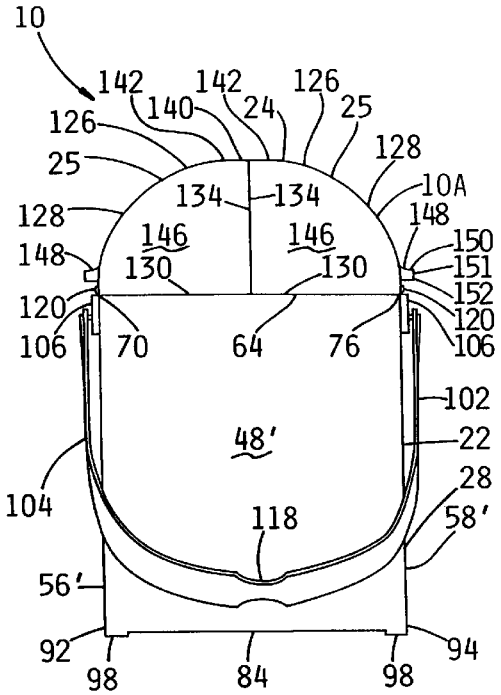
FIG. 4 is a rear view of the device of FIG. 1.

Moving upwardly toward the opening 31 of the container 22, as best shown in FIGS. 1, 3 and 11 for the first embodiment 10A, and in FIGS. 22, 24, and 33 for the second embodiment 10B, the walls 28 of the container 22 have a spout portion projecting outwardly from the front wall 46' defining the aforementioned pour spout 80. The pour spout 80 has an upper edge 99 preferably located at the upper perimeter wall edge 30 of the opening 31 of open-topped container 22. Pour spout 80 has a lower edge 101 integral with and intersecting base 26. The pour spout 80 is useful for draining fluids 44 or cleaning solutions 81 from the device 10. After the device 10 has been drained of fluids 44 or solutions 81, the pour spout 80 also allows for entry and circulation of air into the device 10 to aid in drying the device 10 and/or the toilet plunger 12 stored in the device 10.

In each of the embodiments 10A, 10B of the device 10, a handle 102 is attached to the walls 28 of the container 22 below the upper perimeter wall edge 30 in a conventional manner using handle lugs. Preferably, the handle 102 is a detachable handle 104 which may be removed from the container 22. Reference is now made to FIGS. 14 and 16 for the first embodiment 10A and to FIGS. 36 and 37 for the second embodiment 10B, which illustrate the preferred use of the detachable handle 104 for use with the device 10. A pair of handle lugs 106 are disposed on the container 22 near the container opening 31, with one handle lug 106 of the pair respectively on the left side wall 50' and the other handle lug 106 on the right side wall 52'. FIG. 14 for the first embodiment 10A and FIG. 36 for the second embodiment 10B, each illustrate an expanded fragmentary view showing the detail of one of the handle lugs 106 of the device 10 with the detachable handle 104 detached from the device 10. Each handle lug 106 has a key hole opening 108 for accepting a handle pin 110. The key hole opening 108 has a top 107 and a bottom portion 109. FIG. 16 is a view of the detachable handle 104 of the first embodiment 10A of the device 10 and is shown detached from the container 22 of the device 10. FIG. 37 is a view of the detachable handle 104 of the preferred embodiment 10B. In each of the embodiments 10A, 10B, the detachable handle 104 has a central portion 112 located between two end portions 114, 116. Each handle pin 110 is suitably dimensioned to fit into key-hole opening 108 of handle lug 106 with a groove (narrow portion) 115 engaging in the key hole opening 108. Groove 115 fits into the top portion 107 of the key-hole opening 108 of handle lug 106. The handle 104 has an exterior surface with a top side and an underside. A triangular-shaped reinforcement 117 is disposed on the top side of the exterior surface and on each end portion 114, 116 behind each handle pin 110. One handle pin 110 is affixed to each end portion 114, 116. The central portion 112 of the detachable handle 104 has an hourglass shaped curved center waist portion 118 to facilitate the resting of the handle 102 against the handle 16 of the plunger 12 when the user is carrying the device 10 or when the user is pouring fluids 44 or cleaning solutions 81 from the device 10. The detachable handle is made of a flexible, strong material, such as, but not limited to a variety of plastics and metals and is preferably made of polypropylene or polyethylene plastics, commercially available from the Solvay Corp. of Houston, Tex. The detachable handle 104 may be removed when the device 10 is cleaned and reattached afterward. The two lid-halves 25 are held secure by the detachable handle 104 when the detachable handle 104 is raised into an upright position as occurs when the device 10 is being carried. In the preferred embodiment 10B, the detachable handle 104 has a reinforcing ridge 119 thereon. The reinforcing ridge 119 is on the underside of the handle opposite the reinforcement 117. The ridge 119 advantageously adds strength to the handle 104 and provides a reinforcement at the waist portion 118. Preferably the ridge 119 extends from a point on the underside of the handle 104 that is opposite an end of the triangular reinforcement 117 to a corresponding end of the second triangular reinforcement 117.

Also located near the opening 31 of the container 22 is a hinge mechanism 120. Preferably each lid-half 25 is attached to the container by a pair of hinge mechanisms 120 permitting each lid-half 25 to pivotly open outside the container 22 without telescoping on the container 22 and without telescoping on the other lid-half 25. Suitable hinge mechanisms 120 include, but are not limited to commercially available metal strap hinges or plastic self-hinges. These hinge mechanisms 120 may be affixed to the container by rivets, screws, bolts, or suitable commercially available adhesive, or may be integral with the container as is known in the art.

As best shown in FIG. 14, the preferred hinge mechanism 120 of the first embodiment 10A of the device 10 is hinge mechanism 120A. Hinge mechanism 120A has three parts, a pair of hinge cylinders 122, and a hinge pin 124. The hinge mechanism 120 is designed so that the lid-halves 25 may be easily removed for cleaning, if desired. Each hinge cylinder 122 is suitably a C-shaped cylindrical projection of the container 22 extending upwardly from the upper perimeter side portion of a side wall, e.g., from upper perimeter left side portion 66 on left side wall 50', extending upwardly from upper perimeter right side portion 68 on right side wall 52' of the open-topped container 22. As best shown in FIG. 15 of the first embodiment 10A of the device 10, where FIG. 15 is an expanded fragmentary side view of the hinge mechanism of FIG. 1, the hinge pin 124 is suitably a solid cylinder in shape and dimensioned to snap into and rotatingly fit within an open interior portion 129 of the C-shaped cylindrical projection. The hinge pin 124 is preferably an integral part of the lid-half 25 and is flanked by rectangular opening 121 and rectangular cut out 123 on the lid-half 25. The lid-half 25 is easily removed by forcing each hinge pin 124 out of its pair of respective C-shaped hinge cylinders 122.

Figure 38A:
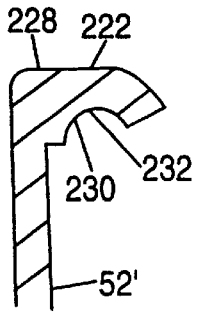
Figure 38B:
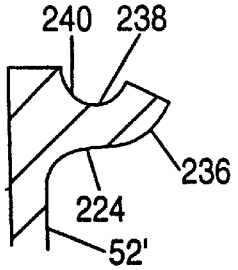
Figure 38C:
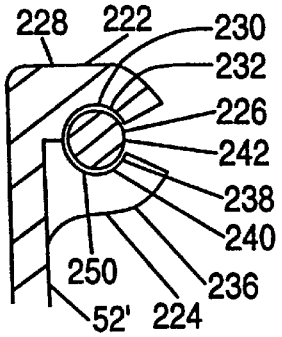
Figure 38D:
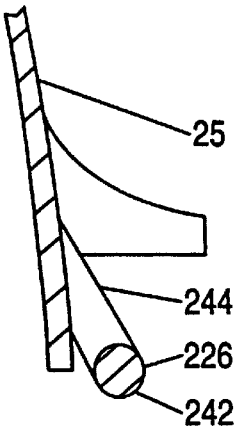

The most preferred hinge mechanism 120 of the second embodiment 10B of the device 10 is hinge mechanism 120B which is known in the art and is best shown in FIGS. 36 and 38A–38D. Hinge mechanism 120B has four parts: two identically dimensioned superior hinge cylinders 222, one inferior hinge cylinder 224 and a hinge pin 226. Like hinge mechanism 120A, the hinge mechanism 120B is designed so that the lid-halves 25 may be removed for cleaning if desired. As best shown in FIGS. 22, 36 and 38A, each superior hinge 222 is a suitably tab-shaped projection 228 of the container 22 extending upwardly and outwardly from the upper perimeter side portion of a side wall, e.g., from upper perimeter left side portion 66 on the left side wall 50', extending upwardly and outwardly from the upper perimeter right side wall 69 on the right side wall 52' of the open topped container 22. The tab -shaped projection 228 has an undersurface 230 having a cup-shaped groove 232 into which the hinge pin 226 fits. As best shown in FIGS. 22, 26 and 38B, the inferior hinge cylinder 224 is located midway between the two superior hinges 222. The inferior hinge cylinder 224 is a tab-shaped projection 236 of the container 22 extending outwardly from the upper perimeter side portion of a side wall, e.g., from upper perimeter left side portion 66 on left side wall 50', extending upwardly and outwardly from upper perimeter right side wall 60 on the right side wall 52' of the open topped container 22. The tab-shaped projection 236 has an upper surface 238 having a cup-shaped groove 240 into which the hinge pin 226 fits. As best shown in FIGS. 22, 36 and 38D, the hinge pin 226 is suitably a solid cylinder 242 extending from and integral with the hinge cylinder bracing tabs 244A–244D (collectively 244). The hinge pin 226 is preferably an integral part of the lid half 25 with the bracing tabs 244 extending outwardly from the exterior surface 146 of the lid half 25. The hinge pin 226 is flanked by a generally rectangular opening 221 on the lid half 25. The solid cylinder 242 is suitably dimensioned to have a radius of curvature to permit acceptance within the cup shaped grooves 232, 236. Two of the bracing tabs 244A, 244D are positioned at either end of the cylinder 242; the remaining two cylinder bracing tabs 244B, 244D are spaced from each other and from bracing tabs 244A, 244D and are disposed along a horizontal axis of the cylinder 242 to permit the cylinder 242 to snap into and rotatingly fit within the cup-shaped grooves 232, 236 of both superior hinges 222 and the inferior hinge 224. As best shown in FIG. 38C, the combined effect of the cup-shaped grooves 232, 240, 232 of the respective hinge pins 222, 224,222 is to create an overall "C"—shaped groove 250 in which the hinge pin 226 rotatingly fits. The lid half 25 is removed by forcing the solid cylinder 242 of hinge pin 226 out of the hinge cylinders 222, 224, 222. Preferably hinge pin is flanked by generally rectangular opening 221 on the lid-half 25.

The upper lid 24 and an internal closure mechanism 125 of both embodiments 10A, 10B will now be described. Preferably, the upper lid 24 is curved, and has two lid-halves 25 of the curved clam-shell type which are mirror-images of each other, hence the same numbering will be used for the same corresponding elements of each lid-half 25. As used herein throughout, the term "mirror-images" is meant to refer to elements that are structurally alike, but are reversed in handedness.

Upper lid 24 has a lid thickness 127. Each curved lid-half 25 has a curved lid-half top 126 and lid-half side walls 128 extending from the lid-half top 126 and terminating in an arch shaped lid-half lower edge 130 and in curved front closure edges 132 and curved rear closure edges 134. When the curved lid 24 is closed, the curved lid-halves 25 abut each other, with the curved front closure edges 132 of one lid-half 25 contacting the curved front closure edges 132 of the other lid-half 25 above the front wall 46' of the container 22 and with the curved rear closure edges 134 of one lid-half 25 abutting the curved rear closure edges 134 of the other lid-half 25 and above the rear wall 48' of the container 22. The pair of lid-half lower edges 130 rest on the upper perimeter wall edge portions 64, 66, 68, 70, 72, 74, 76 and 62 except for the perimeter projection 78, defining the pour spout 80. The lid thickness 127 and container wall thickness 27 are preferably approximately equal in dimension.

The curved lid 24 has a portion defining a hole 140 with hole edges 142. The hole 140 is of sufficient dimension to permit a toilet plunger handle 16 to penetrate the hole 140 and to move freely through the hole 140. This means that the hole 140 must at least accommodate the circular cross-sectional area of the handle of the toilet plunger 12. The hole 140 penetrates the top 126 both of the lid-halves 25. Preferably, the hole 140 in the lid 24 is circular in area with the area equally apportioned between the curved lid-halves 25 and continuous between the curved lid-halves 25, penetrating both curved lid-half tops 126 when the upper lid 24 is closed. Preferably, the largest diameter dimension of the hole 140 is determined by multiplying the largest diameter of handle 16 of commercially available toilet plunger 12 by a factor of 1.5. This dimension is sufficient to allow easy closure of the lid-halves 25 and advantageously to provide for air circulation within the device 10.

Each curved lid-half 25 has an interior surface 144 and an opposite exterior surface 146. Advantageously, the lid may be opened from outside the device 10, without touching the interior surface 144 of the lid-halves 25. The upper lid 24 also has a pair of tabs 148, with one of each of the pair of tabs 148 on the exterior surface 146 of each lid-half 25 near the lid-half lower edge 130. A tab 148 extends outwardly from the exterior surface 146 of each lid-half 25 near the lid-half lower edge 130 and above the handle 102. The tabs 148 have a curved upper portion 150, a radiused side wall 151 and an opposing edge portion 152. The curved upper portion 150 of tab 148 may be pressed downward by the user to manually open the lid-halves 25. The angled end portion 152 then pivots downwardly and is stopped in travel by the handle lug 106 or by the handle 102. This prevents the further travel of the lid-half 25.

In the preferred embodiment 10B closure edges 132 and 134 each have a rim 300 extending inwardly therefrom.

In each of the embodiments 10A and 10B of the device 10, an internal closure mechanism 125 is disposed within the lid-halves 25 and advantageously closes and opens the device 10 from within using toilet plunger 12 itself. The internal closure mechanism 125 comprises a pair of mirror-imaged closure members 154, hence the same numbering will be used for corresponding elements of each closure member 154. One of each of the pair of closure members 154 is integral with and extends from the interior surface 144 of each lid-half side wall 128 into the interior 32 of the device 10. For the first embodiment 10A, this is best shown in FIGS. 8A, 8B, 10–12A, 13, and 17–21 G; for the preferred second embodiment 10B, this is best shown in FIGS. 29–30, 32–33 and 39–43G. Each closure member 154 has at least one lever/bumper member 155. Each lever bumper member 155 has a first end 156 and a second end 157. The bumper ever member has thickness 159. As best illustrated in FIGS. 8A and 8B for the first embodiment 10A, each closure member 154 has a single lever/bumper member 155 which approximately bisects the curved lid-half 25 and is located with the first end 156 adjacent the edge 142 of hole 140 and with the second end 157 near lid-half lower edge 130. For the second embodiment 10B, as best illustrated in FIGS. 29 and 30, each closure member 154 approximately bisects the curved lid-half 25 and is located with the first end 156 of a lever/bumper member 155 immediately adjacent to and abutting the edge 142 of the hole 140 and the second end 157 of the same lever/bumper member 155 near the lid-half lower edge 130. The advantage of positioning of the first end 156 of the lever/bumper member 155 immediately next to the edge 142 of the hole 140 of the lid-halves 25 is that this positioning enables the widest variety of toilet plungers 12 having various cup shapes and dimensions to make contact with a bumper 158 of the bumper/lever member 155 and thereby to cause the lid-halves 25 to open when the toilet plunger 12 is pulled out of the device 10.

In each embodiment 10A, 10B, each lever/bumper member 155 has two sections which are integral with each other. The first section of the lever/bumper member 155 is the bumper 158 and the second section of the lever/bumper member 155 is a lever 160. The bumper 158 is a curved member for engaging the side wall 18 of the cup 14 of the toilet plunger 12. The bumper 158 has a D-shaped curve portion 170 directly adjacent to an inwardly bent section 172. The D-shaped curve portion 170 has a radius dimension. The lever 160 is a generally linear member for engaging the end wall of the cup 14 of the toilet plunger 12. The lever 160 is contiguous with the inwardly bent section 172 of the bumper 158. The lever 160 has a generally truncated triangular shape with a first side 176, an opposite second side 178 and a third side 180 connecting the first side 176 and second side 178. The second side 178 and the third side 180 of lever 160 are spaced from the interior surface 144 of the lid-half 25. As best shown in FIGS. 10 and 11 for the first embodiment 10A, the second side 178 of lever 160 extends approximately parallel to a side wall of the container 22 when the lid-halves 25 are closed. As best shown in FIGS. 32 and 33 for the second embodiment 10B, the second side 178 of lever 160 extends angled from a side wall of the container 22 when the lid-halves 25 are closed.

In each of the embodiments 10A, 10B, each of the bumper/lever members 155 of the closure member 154 has a peripheral edge surface 184 having a curved peripheral portion 187 corresponding to the D-shaped curved portion of the bumper 158, a curved peripheral portion 186 corresponding to the inwardly bent portion 172 of the bumper 158 and a linear peripheral portion 188 corresponding to the first side 176.

As best shown in FIG. 17, for the first embodiment 10A of the device 10, each closure member 154 has a single lever/bumper member 155 in each lid-half 25. As best shown in FIGS. 17 and 18, for the first embodiment 10A, two equal side flanges 182, extend outwardly at approximately 90° angles from D-shaped curve portion 170, inwardly bent section 172 and first side 176, and are continuous forming the peripheral edge surface 184 of closure member 154.The peripheral edge surface 184 has the curved peripheral portion 187 corresponding to the D-shaped curved portion of the bumper 158, the curved peripheral portion 186 corresponding to the inwardly bent portion 172 of the bumper 158, and the linear peripheral portion 188 corresponding to first side 176. The side flanges 182 in co-operation with the D-shaped curved portion 170, the inwardly bent portion 172 and the first side 176 form a T-bar construction when the bumper 158 and the lever 160 are viewed in cross-section, as illustrated in FIGS. 8B, 17 and 18. The T-bar construction of bumper 158 and lever 160 provides exceptional cross-sectional strength at minimum weight and material usage.

In the preferred embodiment 10B of the device, the closure member 154 has a plurality of juxtaposed identically dimensioned lever/bumper members 155 in each lid half 25 joined by a cross member. As best shown in FIGS. 39A, 39B and 40, each closure member 154 most preferably includes a pair of juxtaposed identically dimensioned lever/bumper members 155. The pair of lever/bumper members 155 have a cross member 181 interconnecting a portion of the pair of bumpers 158 as well as the levers 160 of each of bumper/lever members 155 of the pair. The cross member 181 is preferably integral with and extends from a cross member location 183 in the interior surface 144 of each lid-half side wall 128 into the interior 32 of the device 10 and extends to the third side 180 of each of the pair of levers 160. Most preferably the third side 180 is rounded in shape. The levers 160 and the cross member 181 of the closure member 154 when viewed in cross section as shown in FIG. 40 form an H-shape. The H-shape construction of the closure member 154 provides an exceptional cross-sectional strength at minimum weight and material usage.

In each of the embodiments 10A and 10B of the device 10, the curved peripheral portion 187 of the bumper 158 is suitably dimensioned to engage the plunger cup side wall 18 of the toilet plunger 12 when the plunger 12 is pulled out of the closed device 10. The linear peripheral portion 188 of the lever 160 is suitably dimensioned for engaging the cup end wall 20 of the toilet plunger 12 when the lid-halves 25 are in the fully open position. As best illustrated in FIGS. 10 and 32, the largest spacing L between the linear portions 188 of the pair of opposing levers is dimensioned to exceed the largest dimension of the cup outer diameter 19 of the plunger cup 14 of the toilet plunger 12, when the lid-halves 25 are in the closed position.

The radius dimension of the D-shaped curve portion 170 of bumper 158 is such that when the plunger 12 is pulled upwardly from the interior 32 of the device 10, the plunger cup side wall 18 strikes each curved peripheral portion 187 of the peripheral edge surface 184 of the curved portion 170 forcing the curved lid-half 25 to open to a point such that the lower edge 130 of the lid-half 25 swings past the vertical. In the second embodiment 10B, the peripheral edge surfaces 184,184 of the two bumpers 158,158 in each pair of juxtaposed lever/bumper members 155,155 of a closure member 154 engage the plunger cup side wall 18. In this position, the curved lid-half 25 will then fall under the influence of gravity into its most open position where the angled end portion 152 of tab 148 stops the travel of the lid by resting against the handle 102 or handle lug 106. This is best shown in FIGS. 21B and 43B.

The length of the lever 160 is such that when the curved lid-halves 25 are open, the distance M, as seen on FIGS. 21B and 43B, between the end sides 180 of the levers 160 is less than the smallest dimension of the cup end wall diameter 21 of the cup end wall 20 of a conventional toilet plunger 12.

Alternatively, as shown in FIG. 19 for the first embodiment 10A, the structure of the internal closure mechanism 125 is suitably modified by removing only the two equal side flanges 182 from the closure member 154 to show a second embodiment of the closure member 154'. The curved peripheral portion 187 of the bumper 158 defines a perimeter 194 of the D-Shaped curved portion 170 of the bumper 158 and the linear peripheral portion 188 of the lever 160 defines a perimeter 196 of first side 176. Without the presence of the flanges 182, a rectangular edge profile is created. As best illustrated in FIGS. 19 and 20, a rectangular edge profile is observed when the internal closure mechanism of this alternative embodiment of the internal closure mechanism is viewed in cross-section. All other elements of the invention utilizing the alternate closure member 154' are as described herein throughout.

Still alternatively, for the second embodiment 10B, as best shown in FIG. 41, the closure member 154 may be made without the connecting cross member 181. In this aspect of the second embodiment 10B of the present invention, a thicker lever/bumper member 154" may be molded or otherwise fabricated. The closure member 154" is located in the lid-half 25 approximately bisecting the curved lid-half 25 and is located with its first end 156 immediately adjacent to and abutting the edge 142 of the hole 140 and with its second end 157 near lid-half lower edge 130. Without the presence of the cross member 181, like closure member 154", a rectangular edge profile is created when the internal closure member 154" is viewed in cross section, as best shown in FIG. 42. All other elements of the present invention utilizing the closure member 154" are as described herein throughout.

Yet still alternatively, as is appreciated by those skilled in the art, the closure member 154 may be modified to have three or more lever/bumper members 155. A cross member 181 is disposed between any pair of bumper/lever members. This modified closure member preferably is disposed abutting the edge 142 of the hole 140, or alternately is spaced from the edge 142 of the hole 140, as previously described herein. All other elements of the embodiment of the invention employing three or more bumper/lever members 155 are as described herein throughout.

As best illustrated in FIGS. 11, 21C and 21G, and in FIGS. 33, 43C and 43G, the container 22 and the lid 24 are dimensioned for enclosing both the plunger cup 14 of the toilet plunger 12 and an enclosed portion 200 of the handle 16 of the toilet plunger 12. The remainder protruding portion 15 of the toilet plunger handle 16 protrudes through the hole 140 in the lid 24. Preferably, device 10 has the following dimensions to accommodate a plunger 12 having a cup diameter of about 14 cm (five and one-half inches).

In one conventional toilet plunger style as shown in FIGS. 11 and 33, cup 14 outer diameter 19 at its widest portion is the same as end wall diameter 17; this dimension is about 14 cm (5½ inches). The plunger handle 16 extends about 45.7 cm (18 inches) above the cup 14 with the overall toilet plunger length about 55.9 cm (22 inches). In another conventional toilet plunger style (as shown in FIGS. 21B–21D, 21F, 21G and in FIGS. 43B–43D, 43F, 43G), plunger cup outer diameter 19 at its widest portion is about 14 cm (5½ inches) and end wall diameter 21 is about 9.5 cm (3¾ inches). Plunger handle 16 extends about 45.7 cm (18 inches) above the cup 14 with the overall toilet plunger length about 60.3 cm (23¾ inches).

In its current configuration, to accommodate either of the plunger styles shown in FIGS. 11 and 33 or in FIGS. 21B–21D, 21F, 21G, and 43B–43D, 43F, 43G, the device 10 of the present invention has the following physical dimensions. Unless specifically specified otherwise, the dimensions of the elements of the device refer to each of the embodiments 10A, 10B of the device 10.

The preferred overall height of each embodiment 10A, 10B of device 10 is about 30.5 cm (12 inches); the height of container 22 is about 21 cm (8¼ inches) the radius of the curved upper lid 24 is about 9.5 cm (3¾ inches). The distance from exterior wall 46' to exterior wall 48' is about 19 cm (7½ inches) and about 19 cm (7½ inches) from exterior wall 50' to exterior wall 52'. Curved corners 54, 56, 58, 60, 54', 56', 58', and 60' of device 10 each have an external radius of about 3.2 cm (1¼ inches). The lower peripheral rim 40 of base 26 is about 1.6 cm (⅝ inches) in depth. Feet 98 extend below the lower edge of rim 40 for a distance of about 0.3 cm (⅛ inch). The pour spout 80 is about 3.8 cm (1½ inches) wide across upper edge 99 of upper perimeter wall edge 30 of the wall 46' and tapers to about 1.3 cm (½ inch) wide across lower edge 101; the pour spout 80 extends about 1.9 cm (¾ inch) outwardly at upper edge 99 and tapers inwardly as it extends downwardly until it is even with the wall 46' at the base 26. Handle lugs 106 are about 1.9 cm (¾ inch) wide and about 2.5 cm (1 inch) tall. The detachable handle 104 is about 50.8 cm (20 inches) in length, 1.9 cm (¾ inch) in width, and 0.25 cm (0.10 inch) thick; the hour-glass shaped waist 118 at the center 112 of the length of detachable handle 104 has the radius of curvature of about a 3.8 cm (1½ inch), 20° ellipse. The lid 24 has an external radius of about 9.5 cm (3¾ inches). Lower lid edge 130 conforms in shape and dimensions to the upper perimeter wall edge 30 of container 22, except for the perimeter projection 78, defining the pour spout 80. Wall thickness of the device 10 is preferably 0.25 cm (0.10 inches). Thus, the lid 24 and the wall 28 of the container 22 each have the same thickness of 0.25 cm (0.10 inches). Thus, lid thickness 127, container wall and lid thickness 127 are preferably equal in thickness. The hole 140 in the top of the lid 24 is about 3.8 cm (1½ inches) in diameter. The thickness of the counterweight is dependent upon the mass of material of its construction; preferably it is made of anodized steel and is about 0.3 cm (⅛ inch) thick in either embodiment 10A, 10B.

In the first embodiment 10 A, the top portion 107 of the key-hole opening 108 in the handle lug 106 has a radius of about 0.2 cm (5/64 inch). The triangular-shaped reinforcement 117 is about 5.1 cm (2 inches) long and about 0.5 cm (3/16 inch) wide at its base and on the surface of detachable handle 104 directly opposite handle pin 110. The handle pin 110 of detachable handle 104 is about 0.4 cm (5/32 inch) long and about 0.6 cm (¼ inch) in diameter; the groove 115, which fits into the top portion 107 of the keyhole opening 108 of the handle lug 106, is about 0.2 cm (1/16 inch) wide and about 0.2 cm (1/16 inch) deep and disposed at the handle pin 110. The width of the thumb tab 148 is about 4.5 cm (1¾ inches); it extends outwardly from the external surface 146 of the lid-half 25 for about 1 cm (⅜ inch), and its outer edge has the curvature of a 3.8 cm (1½ inch) 30° ellipse. Hinge pins 126 are preferably an integral part of lid-halves 25. Each hinge pin 124 is about 2.9 cm (1⅛ inches) long and about 0.1 cm (3/64 inch) in diameter. The C-shaped hinge cylinders 122 are an integral part of the walls 50' and 52' of container 22 and have an inside diameter of about 0.2 cm (1/16 inch). The open interior portion 129 of the C-shaped projections is about 0.1 cm (1/32 inch). The D-shaped curved portion 170 of each closure member 154 has a radius of about 3.2 cm (1¼ inches). Inwardly bent section 172 has a radius of about 0.6 cm (¼ inch).The lever portion 160 of closure member 154 is about 10.2 cm (4 inches) in length. The thickness 159 is about 0.24 cm (3/32 inch). Each of the side flanges 182 extends outwardly about 1.03 cm (13/32 inch). The portion 170 begins about 1.3 cm (½ inch) from the hole edges 142. The spacing L is about 15.6 cm (6⅛ inches). The distance M is about 5.1 cm (2 inches). The counterweight 45 is about 15.2 cm (6 inches) in diameter and about 15.2 cm (6 inches) in diameter. The parallel grooves 42 in the top surface of the base 26 have a radius of about 0.6 cm (¼ inch) and are separated by about 1.3 cm (½ inch) wide flat base portions 43.

In the second embodiment 10B, the top portion 107 of the key-hole opening 108 in the handle lug 106 has a radius of about 0.33 cm (17/132 inch). The triangular-shaped reinforcement 117 is about 7.6 cm (3 inches) long and about 0.5 cm (3/16 inch) wide at its base and on the surface of detachable handle 104 directly opposite handle pin 110. The handle pin 110 of the detachable handle 104 has an overall length of about 0.6 cm (0.25 inch). The groove (narrowed part) 115 is about 0.6 cm (0.25 inch) in diameter and about 0.4 cm (5/32 inch) in length and fits into the top portion 107 of the key-hole opening 108 of the handle lug 106. The nonattached end of the handle pin is about 0.9 cm (⅜ inch) in diameter and about 0.2 cm (3/32 inch in length). The reinforcing ridge protrudes outwardly from the handle by 0.3 cm (⅛ inch) and is 0.25 cm (7/64 inch) wide. The width of the thumb tab 148 is about 3.8 cm (1.5 inches); it extends outwardly from the external surface 146 of the lid-half 25 for about 1.3 cm (0.5 inch), and its outer edge is parallel to its inner edge; the ends of the thumb tab have a 1.3 cm (0.5 inch) radius. Each hinge pin 124 of the hinge mechanism 120B is about 3.5 cm (1⅜ inches) long and about 0.4 cm (21/132 inch) in diameter. The tab-shaped superior hinge cylinders 222 and the inferior hinge cylinder 224 are an integral part of the wall 50' and 52' of the container. The cup-shaped grooves 232, 240, 232 in each respective hinge cylinder 222, 224, 222 has a radius of curvature of about 0.2 cm (11/132 inch). The rim 300 on each closure edge 132, 134 extends about 0.3 cm (⅛ inch) and has a rim thickness of about 0.25 cm (7/64 inch). The D-shaped curved portion 170 of each closure member 154 has a radius of about 3.8 cm (1.5 inches). Inwardly bent section 172 has a radius of about 0.6 cm (¼ inch). End 156 of the D-shaped portion 170 is positioned immediately at the hole edge 142. The lever portion 160 of closure member 154 is about 12.7 cm (5 inches) in length. The spacing L is about 16.5 cm (6.5 inches). The distance M is about 4.4 cm (1.75 inches). The cross member 181 is about 0.24 cm (3/32 inch) thick and 11.4 cm (4.5 inches) long. The wall thickness 159 is about 0.24 cm (3/32 inch). The counterweight is about 15.25 cm (6 inches by 6 inches) square. The parallel base ridges 42' have a radius of about 0.6 cm (¼ inch) and are separated by about 1.3 cm (½ inch) wide flat base portions 43'.

As is appreciated by those skilled in the art, the device may be dimensioned appropriately to accommodate different sized toilet plungers.

The method of use of the present invention for opening and closing the device using the toilet plunger will now be described. FIGS. 21A–21H (for the first embodiment 10A) and FIGS. 43A–43H (for the second embodiment 10B) illustrate the methods of using, i.e., the operation of device 10 of the present invention for storing and cleaning a toilet plunger 12. FIGS. 21A–21D and FIGS. 43A–43D illustrate the method of opening and closing the device 10 using the toilet plunger 12. FIGS. 21A–21G utilize the cross-sectional view of FIG. 13 and FIGS. 43A–43G utilize the cross-sectional view of FIG. 32; thus, the views look into the interior 32 of the device 10 toward the rear wall 48' of the device 10. FIG. 21H is a side view of the first embodiment 10A of the device 10; FIG. 43H is a side view of the second embodiment 10B of the device 10.

As best shown in FIG. 21A and in FIG. 43A, the present invention is used in the following way to load a toilet plunger 12 into the device 10 when the lid-halves 25 are closed. The tabs 148 on the lid-halves 25 are depressed downwardly by the user preferably with the user's thumbs. Downward arrows on FIG. 21A and on FIG. 43A illustrate the downward movement of the tabs 148; the curved arrows illustrate the travel of the lid-halves 25 to the fully open position. The downward pressure on the tabs 148 causes the lid-halves 25 to pivot away from each other and to open the lid-halves 25 exposing the interior 29 of the container 22, as shown in FIG. 21B and FIG. 43B, respectively. Each lid-half 25 travels sidewards and downwardly until the tab 148 rests on the handle 102 or handle lug 106 of the container 22 of the device 10.

FIG. 21B and FIG. 43B also illustrate how the plunger 12 is lowered with the plunger cup 14 oriented downwardly into the open lid-halves 25 and into contact with the levers 160. The downward arrow illustrates the downward movement of the toilet plunger 12. When the cup end wall 20 of the plunger 12 contacts the linear peripheral portions 188 of the levers 160, the user continues to lower the plunger 12 downwardly, whereby the cup end wall 20 presses downwardly onto the levers 160 of the internal closure mechanism 125 of the lid-halves 25, thereby causing the lid-halves 25 to pivot upwardly, as illustrated by the upwardly curving arrows, to close the container 22 with the lid-half closure edges 132, 134 of one lid-half 25 abutting the corresponding closure edges 132, 134, on the other lid-half 25.

The plunger 12 is further lowered by the user to permit the plunger cup end wall 20 to rest upon the base 26 as best shown in FIGS. 21C and 43C. If the device 10 is used for storing the toilet plunger 12 at this time, any fluids 44 adhering to the plunger cup 14 drain into the grooves 42 (in the first embodiment 10A) or in the base flat portions 43' (in the preferred embodiment 10B) in the base 26. If the fluid amount is minimal, e.g., the grooves 42 or the base flat portions 43' are not filled with fluid 44, the plunger cup 12 is dried by the air circulation through the pour spout 80, lid hole 140 and grooves 42 (for the first embodiment 10A) or base flat portions 43' (for the preferred embodiment 10B). If the fluid 44 fills the grooves 42/or base flat portions 43' the user can drain the device 10, as will be explained hereinafter in association with FIGS. 21H and 43H.

To remove the toilet plunger 12 from the device 10, it is only necessary for the user to grasp the remainder protruding portion 15 of the plunger handle 16 and to pull the plunger 12 upwardly and out of the device 10, as illustrated in FIGS. 21D and 43D. Upward arrows illustrate the upward movement of the toilet plunger 12. The upward movement of the plunger 12 causes the plunger cup side wall 18 to contact the curved peripheral portions 187 of the opposing pair of bumpers 158 in the lid-halves 25, causing the lid-halves 25 to pivot open. Advantageously, the user never has to touch the soiled toilet plunger 12 or any parts inside the device 10 to load or to remove the toilet plunger 12, thus minimizing the possibility of bacterial contamination of the user. Most advantageously, the counterweight 45 provides additional stability to the device 10 during this step, maintaining the device 10 in an upright position while the plunger 12 is being pulled out of the device 10.

FIGS. 21A, 21E–21H and FIGS. 43A, 43E–43H illustrate the present method of cleaning a toilet plunger in the device 10 of the present invention. If the device 10 is used for cleaning the toilet plunger 12, the device 10 may be opened by the user by depressing the tabs 148 on the lid-halves 25 with the user's thumbs, as previously explained herein and illustrated in FIGS. 21A and 43A.

As shown in FIGS. 21E and 43E, sufficient quantities of cleaning solutions 81 are poured into the container 22. Typically, the cleaning solution is in a quantity sufficient to cover any soiled parts of the toilet plunger. The cleaning solution may be a commercially available household cleaning product or a soap or detergent and water mixture, or a bleach and water mixture, or a disinfectant solution, or water, or safe mixtures thereof, e.g., combinations of the preceding which do not pose a health problem to the user.

As is best illustrated in FIGS. 21F and 43F, the toilet plunger 12 is inserted orienting the plunger cup 14 downwardly into the interior 29 of the container 22 as previously discussed in conjunction with FIGS. 21B and 43B, thereby closing the device 10. Again the downward arrows illustrate the downward force by the plunger cup 14 on the levers 160 of the internal closure mechanism 125, thereby causing the upward rotation of the lid halves 25 (as shown by the curved upward arrows) to close the container 22 of the device 10.

As best illustrated in FIGS. 21G and 43G, the toilet plunger is allowed to soak in the cleaning solution 81 for an appropriate time period to clean it.

If the fluid 44 fills the grooves 42 or base flat portions 43', or if cleaning solution 81 is in the device 10, the user can drain the device 10, as best illustrated in FIGS. 21H and 43H, by grasping the rim 40 with the fingers of one hand while holding the handle 102 in the other hand and tilting the device 10 sufficiently to permit the drainage 91, e.g., fluids 44 and/or cleaning solution 81 to drain out of the device 10 via the pour spout 80. Advantageously, the user avoids contact with the drainage 91 since the user does not have to touch the inside of the device 10 or the toilet plunger 12, thereby avoiding contact with possible bacterial contamination and/or harsh or messy cleaning solution.

The toilet plunger 12 may be removed from the device 10 by pulling the plunger handle 16 upwardly out of the device 10 as previously explained and illustrated in FIGS. 21D and 43D. When device 10 is carried, the two lid-halves 25 are held secure by detachable handle 104, as is also illustrated in FIGS. 21H and 43H.

While the present invention has now been described and exemplified with some specificity, those skilled in the art will appreciate the various modifications, including variations, additions, and omissions, that may be made in what has been described. Accordingly, it is intended that these modifications also be encompassed by the present invention and that the scope of the present invention be limited solely by the broadest interpretation that lawfully can be accorded the appended claims.

We claim:

1. A device for storing and cleaning a toilet plunger having a handle and a cup disposed at one end thereof, the cup having a side wall terminating in a cup end wall, said device, comprising:

(a) an open-topped plunger-receiving container;

(b) a lid comprising two lid-halves, each said lid-half having an interior surface and an exterior surface, said lid having a hole therethrough, said hole penetrating said two lid-halves;

(c) a hinge mechanism connecting each said lid-half to said container; and (d) an internal closure mechanism disposed within said lid and extending from said interior surface of each said lid half into said device, and adjacent said hole, said internal closure mechanism comprising a plurality of curved members for engaging the side wall of the cup of the toilet plunger and a plurality of linear members for engaging the end wall of the cup of the toilet plunger.

2. The device of claim 1, wherein said container has a base having upstanding side walls, said base having a base top with a top surface and an opposing bottom surface, said base having a raised portion and a lowered portion.

3. The device of claim 2, wherein said container further comprises a counterweight disposed on said bottom surface of said base.

4. The device of claim 2, wherein said side walls have a spout portion defining a pour spout.

5. The device of claim 1, wherein said container and said lid are dimensioned for enclosing both the cup of the toilet plunger and a portion of the handle of the toilet plunger such that a remainder of the handle protrudes through said hole in said lid.

6. A device for storing and cleaning a toilet plunger having a handle with opposed ends and a cup disposed at one end thereof, the cup having a side wall terminating in a cup end wall, said device comprising:

(a) a container;

(b) a curved lid having two curved lid-halves;

(c) means for pivotly connecting each said lid-half to said container, said means permitting said lid-halves to open outside said container without telescoping on said container and without telescoping on each other; and (d) means for closing and opening said lid-halves using the toilet plunger.

7. The device of claim 6, wherein each said lid-half has an interior surface and an exterior surface, and wherein said means for both closing and opening said lid-halves is a pair of mirror-imaged closure members, one of each said closure members projecting from one said interior surface of one of each said lid-halves, into said device and wherein each said closure member has a pair of bumper/lever members joined by a cross member, each said bumper/lever member having a D-shaped curved portion for engaging the side wall of the cup of the toilet plunger, and for opening said lid-halves, and wherein each said bumper/lever member has a linear portion adjoining said D-shaped curved portion, said linear portion for engaging the end wall of the cup of the toilet plunger and for closing said lid-halves, said cross member joining said linear portions of said pair of said bumper/lever members.

8. The device of claim 7, wherein said container has a base having upstanding side walls, said base having a base top with a top surface and an opposing bottom surface, said base top having a portion defining a ridge.

9. The device of claim 8, wherein said container further comprises a counterweight disposed on said bottom surface.

10. The device of claim 8, wherein said side walls have a spout portion defining a pour spout.

11. A device for storing and cleaning a toilet plunger of the type having a handle with opposed ends and a cup disposed at one end thereof, the cup having a side wall terminating in a cup end wall, said device comprising:

(a) an open-topped container, said container having a base having upstanding side walls, a base top with a top surface and a base bottom with an opposing bottom surface, said base top having a plurality of base raised portions and said side walls having a spout portion defining a pouring spout;

(b) a curved lid having two curved lid-halves, each lid-half having an interior surface and an exterior surface, said lid having a hole therethrough, said hole penetrating said two lid-halves;

(c) a hinge mechanism connecting each said lid-half to said container; and (d) a pair of closure members, each closure member projecting from said interior surface of said lid-half; each said closure member having a plurality of bumper/lever members, each bumper/lever member having a bumper and a lever with said bumper abutting an edge of said hole, said bumper having a D-shaped curve portion and an inwardly bent section, said D-shaped curved section directly adjacent to said inwardly bent section, and said lever having a truncated triangular shape with a first side, an opposite second side and a third side connecting said first side and said second side, said first side continuous with said inwardly bent section of said bumper.

12. The device of claim 11, wherein said closure member comprises a pair of identically dimensioned bumper/lever members having a connecting member joining said pair of bumper/lever members.

13. The device of claim 12, wherein said closure member has an H-shaped cross-section at a point where said connecting member joins said pair of bumper/lever members.

14. The device of claim 12, wherein said D-shaped curved portion of said bumper is suitably dimensioned for engaging the side wall of the cup of the toilet plunger and wherein said first side of said lever is suitably dimensioned for engaging the end wall of the cup of the toilet plunger.

15. The device of claim 12, wherein said container further comprises a counterweight spaced from said top surface and under said base raised portions.

16. The device of claim 11, wherein said container and said lid are dimensioned for enclosing both the cup of the toilet plunger and a portion of the handle of the toilet plunger such that said handle protrudes through said hole in said lid.

17. The device of claim 11, further comprising a detachable handle releasibly affixed to said container.

18. The device of claim 13, wherein each said lid-half has an outwardly projecting tab on said exterior surface, said tab disposed proximate said hinge mechanism.

19. A method for opening and closing a toilet plunger storing and cleaning device, using a toilet plunger having a handle with opposed end, and a cup disposed at one end thereof and having a sidewall terminating in a cup end wall, said method comprising the steps of:

(a) opening a device having (i) an open-topped container having an interior, (ii) a lid thereto having two lid-halves and a hole therethrough, (iii) a hinge mechanism connecting each said lid-half to said container, and (iv) an internal closure mechanism disposed within said lid and adjacent said hole; said hole penetrating said two lid-halves; each said lid-half having an interior surface, an exterior surface, and a tab extending from said exterior surface; said internal closure mechanism having at least one curved member having a curved portion for engaging the side wall of the cup of the toilet plunger and at least one linear member having a linear portion for engaging the end wall of the cup of the toilet plunger; by depressing each said tab of said lid-halves causing each said lid-halves to pivot about said hinge mechanism to open and expose said interior of said container;

(b) lowering the toilet plunger into said interior of said container;

(c) engaging the end wall of the cup of the toilet plunger against said linear portion, causing said lid-halves to pivot shut to close said device;

(d) resting the end wall of the cup of the toilet plunger in said container and enclosing both the cup of the toilet plunger and a portion of the handle of the toilet plunger and wherein a remainder of the handle protrudes through said hole in said lid;

(e) grasping the handle and pulling the handle toward said lid-halves; and (f) engaging the side wall of the cup of the toilet plunger against said curved portion, causing said lid-halves to pivot open to open said device.

20. A method of cleaning a toilet plunger using a device for storing and cleaning a toilet plunger having a handle with an opposed end, and a cup disposed at one end thereof and having a sidewall terminating in a cup end wall, said method comprising the steps of:

(a) opening a device comprising (i) an open-topped container having an interior defined by upstanding walls and a base, said walls having a spout portion defining a pour spout, (ii) a lid having two lid-halves and a hole therethrough, each lid-half having an interior surface, an exterior surface, and a tab extending from said exterior surface; said hole penetrating said two lid-halves, (iii) a hinge mechanism connecting each said lid-half to said container, and (iv) an internal closure mechanism disposed within said lid and adjacent said hole, said internal closure mechanism having at least one curved member having a curved portion for engaging the side wall of the cup of the toilet plunger and at least one linear member having a linear portion for engaging the end wall of the cup of the toilet plunger, by depressing said tabs on said lid-halves causing each said lid-half to pivot about said hinge mechanism opening and exposing said interior of said container;

(b) pouring a cleaning solution into said container;

(c) lowering the toilet plunger into said container;

(d) engaging the end wall of the cup of the toilet plunger against said linear portion, causing said lid-halves to pivot shut, closing said device;

(e) resting the end wall of the cup of the toilet plunger in said container and enclosing both the cup of the toilet plunger and a portion of the handle of the toilet plunger and a remainder of the handle protrudes through said hole in said lid;

(f) soaking the toilet plunger in the cleaning solution; and (g) tipping said device and draining the cleaning solution from said device through said pour spout.

* * * * *